US011630414B2

(12) United States Patent
Hashimoto et al.

(10) Patent No.: US 11,630,414 B2
(45) Date of Patent: Apr. 18, 2023

(54) DEVELOPING CARTRIDGE INCLUDING INCLINED SURFACE MOVABLE TOGETHER WITH CASING AND DEVELOPING ROLLER RELATIVE TO PHOTOSENSITIVE DRUM

(71) Applicant: BROTHER KOGYO KABUSHIKI KAISHA, Nagoya (JP)

(72) Inventors: Junichi Hashimoto, Toyohashi (JP); Yuwen Wang, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/482,978

(22) Filed: Sep. 23, 2021

(65) Prior Publication Data

US 2022/0057744 A1 Feb. 24, 2022

Related U.S. Application Data

(63) Continuation of application No. PCT/JP2020/005475, filed on Feb. 13, 2020.

(30) Foreign Application Priority Data

Mar. 28, 2019 (JP) ..... JP2019-063303

(51) Int. Cl.
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1821* (2013.01); *G03G 21/1842* (2013.01)

(58) Field of Classification Search
CPC ..... G03G 21/1647; G03G 21/1676; G03G 21/1821; G03G 21/1842
See application file for complete search history.

(56) References Cited

U.S. PATENT DOCUMENTS

2001/0024581 A1 9/2001 Miyabe et al.
2006/0083544 A1 4/2006 Okabe
(Continued)

FOREIGN PATENT DOCUMENTS

CN 207882669 U 9/2018
EP 1 118 912 A2 7/2001
(Continued)

OTHER PUBLICATIONS

International Search Report and Written Opinion issued in related international application No. PCT/JP2020/005475, dated Mar. 24, 2020.
(Continued)

*Primary Examiner* — Sophia S Chen
(74) *Attorney, Agent, or Firm* — Merchant & Gould P.C.

(57) ABSTRACT

The developing cartridge includes a casing, a developing roller, and a first inclined surface. The first inclined surface is positioned at an outer surface of one end portion of the casing in the second direction. The first inclined surface is fixed to the casing and is inclined relative to the first direction. The first inclined surface is movable in the first direction relative to the photosensitive drum between a first position and a second position together with the casing and the developing roller in a state where the developing cartridge 1 is attached to a drum cartridge. In a state where the first inclined surface is at the first position, the developing roller is in contact with the photosensitive drum. In a state where the first inclined surface is at the second position, the developing roller is in separation from the photosensitive drum.

24 Claims, 18 Drawing Sheets

(56) References Cited

U.S. PATENT DOCUMENTS

| | | | | |
|---|---|---|---|---|
| 2007/0071495 | A1 | 3/2007 | Hashimoto et al. | |
| 2008/0138107 | A1 | 6/2008 | Mori et al. | |
| 2011/0064457 | A1 | 3/2011 | Okabe et al. | |
| 2012/0269547 | A1 | 10/2012 | Kishi | |
| 2015/0093146 | A1 | 4/2015 | Sato et al. | |
| 2016/0179051 | A1 | 6/2016 | Kim et al. | |
| 2017/0248908 | A1 | 8/2017 | Mizutani | |
| 2017/0261917 | A1 | 9/2017 | Harada et al. | |
| 2017/0261920 | A1 | 9/2017 | Kawamura et al. | |
| 2019/0302682 | A1 | 10/2019 | Wang et al. | |
| 2020/0379401 | A1 * | 12/2020 | Wang | G03G 21/1676 |

FOREIGN PATENT DOCUMENTS

| | | | | |
|---|---|---|---|---|
| EP | 2469349 | A2 * | 6/2012 | G03G 21/1821 |
| EP | 3 998 510 | A1 | 5/2022 | |
| JP | 60-125865 | A | 7/1985 | |
| JP | 5-035078 | A | 2/1993 | |
| JP | 2006-119220 | A | 5/2006 | |
| JP | 2006-259448 | A | 9/2006 | |
| JP | 2008-170950 | A | 7/2008 | |
| JP | 2008-185737 | A | 8/2008 | |
| JP | 2011-059510 | A | 3/2011 | |
| JP | 2017-156435 | A | 9/2017 | |
| JP | 2017-167523 | A | 9/2017 | |
| JP | 2019-028147 | A | 2/2019 | |
| WO | 2013/187534 | A1 | 12/2013 | |

OTHER PUBLICATIONS

Extended European Search Report issued in corresponding European 20780042.6, dated Dec. 5, 2022.

* cited by examiner

DEVELOPING CARTRIDGE INCLUDING INCLINED SURFACE MOVABLE TOGETHER WITH CASING AND DEVELOPING ROLLER RELATIVE TO PHOTOSENSITIVE DRUM

CROSS REFERENCE TO RELATED APPLICATION

This is a by-pass continuation application of International Application No. PCT/JP2020/005475 filed Feb. 13, 2020 claiming priority from Japanese Patent Application No. 2019-063303 filed Mar. 28, 2019. The entire contents of the International Application and the priority application are incorporated herein by reference.

TECHNICAL FIELD

The present disclosure relates to a developing cartridge.

BACKGROUND

Conventionally, there have been known electro-photographic type image-forming apparatuses such as a laser printer and an LED printer. Such conventional image-forming apparatuses include a developing cartridge. The developing cartridge includes a developing roller for supplying developing agent. One of the conventional image-forming apparatuses includes a drum cartridge. The drum cartridge includes a photosensitive drum. The developing cartridge is attached to the drum cartridge. When the developing cartridge is attached to the drum cartridge, the photosensitive drum and the developing roller contact each other.

SUMMARY

The above-described conventional image-forming apparatus is switchable between a state where the developing roller and the photosensitive drum are in contact with each other and a state where the developing roller and the photosensitive drum are spaced apart from each other. In this conventional image-forming apparatus, components for moving the developing cartridge to separate the developing roller from the photosensitive drum are provided at each side of a drum unit. Therefore, the components at each side need to receive a driving force from a main body of the image-forming apparatus.

In view of the foregoing, it is an object of the present disclosure to provide a developing cartridge capable of separating a developing roller from a photosensitive drum by application of a driving force only to one side, without necessitating application of a driving force to each side.

In order to attain the above and other objects, according to one aspect, the present disclosure provide a developing cartridge including a casing, a developing roller, and a first inclined surface. The developing cartridge is attachable to a drum cartridge including a photosensitive drum. The casing is configured to accommodate therein developing agent. The developing roller is rotatable about a developing roller axis extending in a first direction. The developing roller is contactable with the photosensitive drum. The developing roller has a circumferential surface having one side portion and another side portion in a second direction crossing the first direction. The one side portion is exposed to an outside of the casing and the another side portion is positioned inside the casing. The first inclined surface is positioned at an outer surface of one end portion of the casing in the second direction. The first inclined surface is fixed to the casing and inclined relative to the first direction. In a state where the developing cartridge is attached to the drum cartridge, the first inclined surface is movable together with the casing and the developing roller in the first direction relative to the photosensitive drum between a first position and a second position. In a state where the first inclined surface is at the first position, the developing roller is in contact with the photosensitive drum. In a state where the first inclined surface is at the second position, the developing roller is in separation from the photosensitive drum.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Embodiments of the present disclosure will be described while referring to the accompanying drawings.

In the following description, a direction in which a rotation axis (a developing roller axis) of a developing roller extends will be referred to as "first direction." Here, an outer circumferential surface of the developing roller has a portion exposed to an outside of a casing, and another portion accommodated inside the casing. A direction in which the exposed portion and the accommodated portion of the circumferential surface are arranged will be referred to as "second direction." The first direction and the second direction cross each other. Preferably, the first direction and the second direction are orthogonal to each other. Furthermore, a direction crossing both the first direction and the second direction (preferably, orthogonal to both the first direction and the second direction) will be referred to as a "third direction."

First Embodiment

1. Outline of Structure of Image-Forming Apparatus

Figure 1:
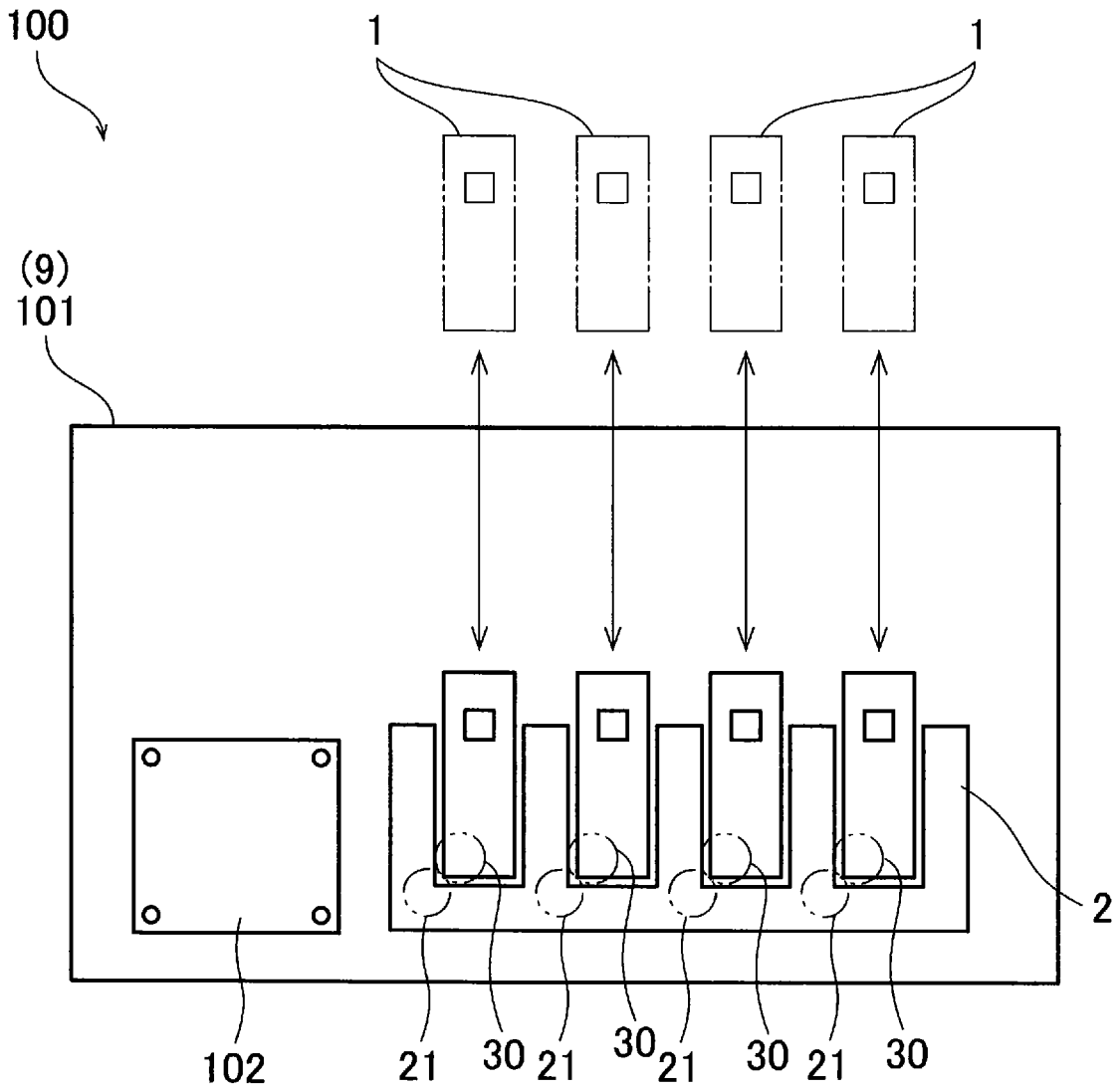
FIG. 1 is a schematic diagram of an image-forming apparatus.

FIG. 1 is a schematic diagram of an image-forming apparatus 100. The image-forming apparatus 100 is an electro-photographic type printer. Examples of the image-forming apparatus 100 include a laser printer and an LED printer. As illustrated in FIG. 1, the image-forming apparatus 100 includes four developing cartridges 1, a drum cartridge 2, and a main body 9.

1-1. Outline of Structure of Main Body

The structure of the main body 9 of the image-forming apparatus 100 will be outlined. As illustrated in FIG. 1, the main body 9 includes a main body frame 101, a transfer belt (not illustrated), and a controller 102.

The main body frame 101 has a generally rectangular parallelepiped shape. The main body frame 101 has an internal space. In a state where the developing cartridges 1 are attached to the drum cartridge 2, the drum cartridge 2 is attached in the internal space of the main body frame 101. Further, four chargers (not illustrated), four light sources (not illustrated), the transfer belt, and the controller 102 are attached in the main body frame 101.

The transfer belt is an endless belt for conveying a printing sheet. In a state where the drum cartridge 2 is attached in the internal space of the main body frame 101 with the developing cartridges 1 attached to the drum cartridge 2, the transfer belt is positioned at the opposite side to developing rollers 30 with respect to photosensitive drums 21. The outer peripheral surface of the transfer belt is contactable with the outer circumferential surfaces of the photosensitive drums 21.

The controller 102 includes a processor such as CPU, and a main body memory. The main body memory is a readable and writable storage medium such as a flash ROM and EEPROM. The main body memory stores therein computer programs for controlling operations of the image-forming apparatus 100. The processor is configured to execute various processes in accordance with the computer programs stored in the main body memory. That is, the processor is configured to execute a printing process and various processes attendant thereto performed by the image-forming apparatus 100.

1-2. Outline of Structure of Developing Cartridge

Figure 2:
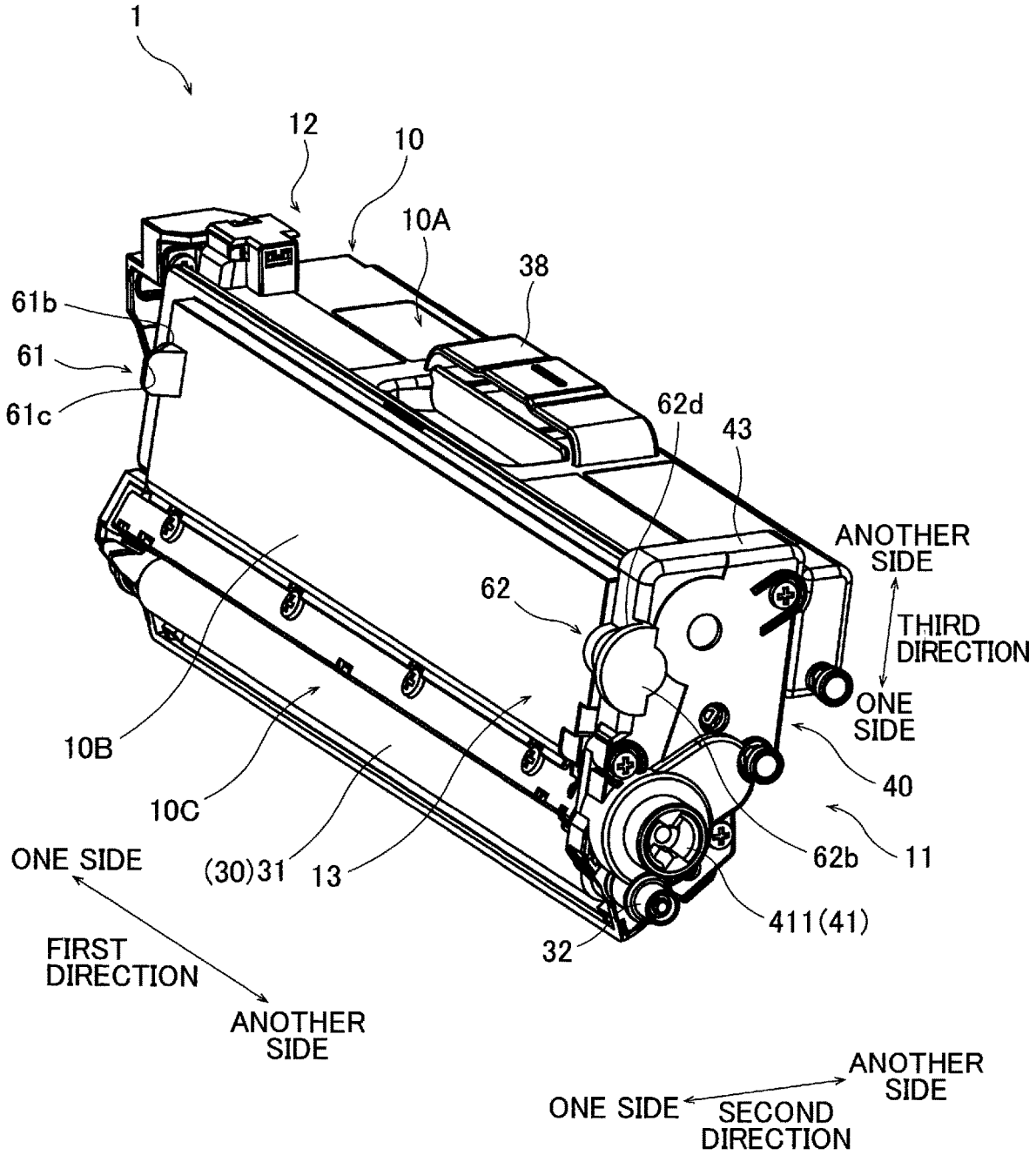
FIG. 2 is a perspective view of a developing cartridge according to a first embodiment.
Figure 3:
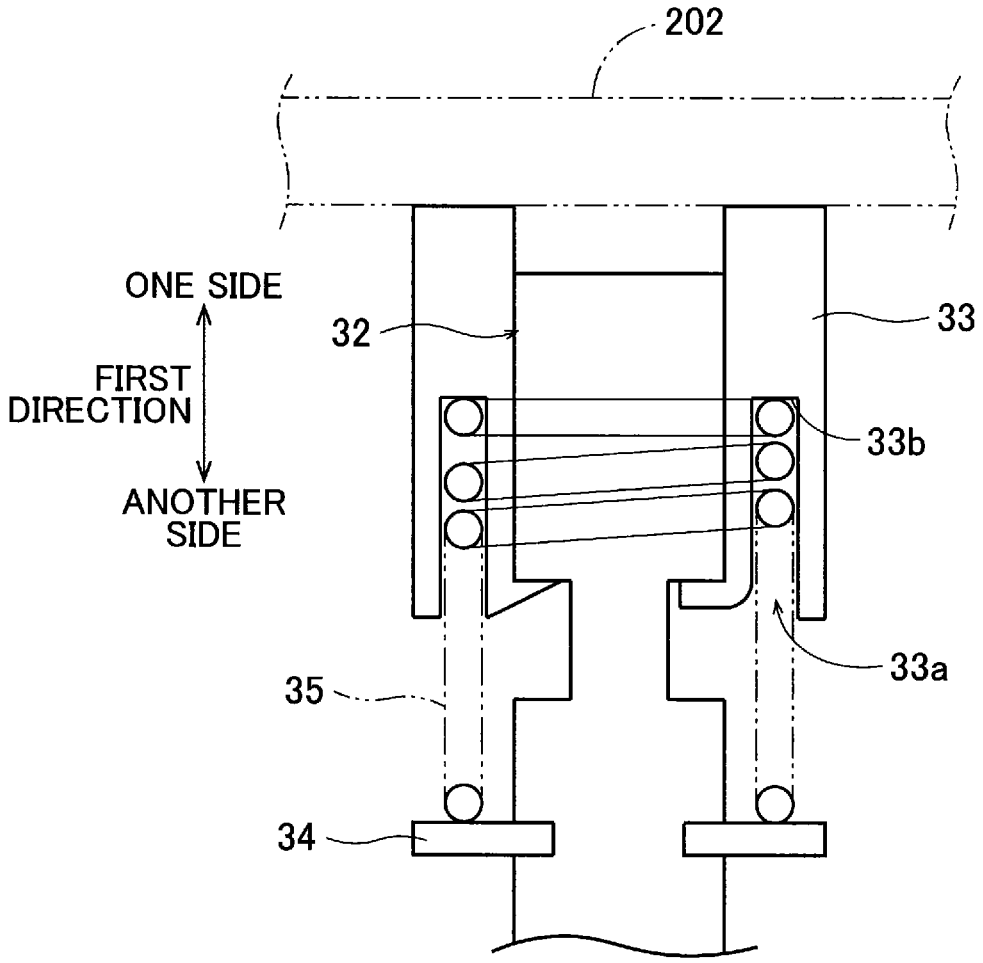
FIG. 3 is a schematic view illustrating one end portion of a developing roller in a first direction.

The structure of the developing cartridge 1 will be outlined while referring to FIGS. 1 to 3. FIG. 2 is a perspective view of the developing cartridge 1. FIG. 3 is a schematic view illustrating one end portion of the developing roller 30 in the first direction.

As illustrated in FIG. 1, the developing cartridge 1 is attachable to and detachable from a drum frame 200 of the drum cartridge 2. As illustrated in FIG. 2, the developing cartridge 1 includes a casing 10 configured to accommodate therein developing agent.

The casing 10 includes a container 10A and a lid 10B. The container 10A has an internal space. The lid 10B is a flat plate shape. The lid 10B is positioned at one end portion of the casing 10 in the second direction. The lid 10B has a third outer surface 13 described later. The lid 10B covers an opening portion formed at one end portion of the container 10A in the second direction. The container 10A has an opening 10C formed at one end portion of the container 10A in the third direction. The developing roller 30 is positioned at the opening 10C.

The casing 10 has one end portion and another end portion in the first direction. The other end portion of the casing 10 in the first direction has a first outer surface 11, and the one end portion of the casing 10 in the first direction has a second outer surface 12. Further, the casing 10 has the third outer surface 13 and a fourth outer surface 14 (FIG. 7) which are spaced apart from each other in the second direction. The third outer surface 13 is positioned at the one end portion of the casing 10 in the second direction. The fourth outer surface 14 is positioned at another end portion of the casing 10 in the second direction.

The four developing cartridges 1 accommodate therein developing agent of different colors (for example, cyan, magenta, yellow and black). However, the four developing cartridges 1 may accommodate therein developing agent of identical color. For example, the developing agent is toner.

The developing cartridge 1 further includes the developing roller 30. The developing roller 30 is a member having a cylindrical shape. The developing roller 30 is rotatable about a developing roller axis which is a rotation axis extending in the first direction. The developing roller 30 is supported by the casing 10 so as to be rotatable about the developing roller axis.

The developing roller 30 includes a roller body 31 and a developing roller shaft 32. The roller body 31 is a cylindrical member extending in the first direction. The roller body 31 is made of elastic material such as rubber. The developing roller shaft 32 is a solid cylindrical member penetrating the roller body 31 in the first direction. The developing roller shaft 32 is made of metal or electrically conductive resin. The roller body 31 is fixed to the developing roller shaft 32 so as not to rotate relative to the developing roller shaft 32. That is, the roller body 31 is rotatable together with the developing roller shaft 32 about the developing roller axis. The circumferential surface of the roller body 31 has one side portion and another side portion in the second direction. The one side portion of the circumferential surface of the roller body 31 in the second direction is exposed to an outside of the casing 10 through the opening 10C. The other side portion of the circumferential surface of the roller body 31 in the second direction is positioned inside the casing 10.

The developing roller shaft 32 has one end portion and another end portion in the first direction. A developing roller gear (not illustrated) is attached to the other end portion of the developing roller shaft 32 in the first direction. The developing roller gear is positioned at the first outer surface 11. The developing roller shaft 32 is fixed to the developing roller gear so as not to rotate relative to the developing roller gear. Hence, when the developing roller gear rotates, the developing roller shaft 32 and the roller body 31 rotate together with the developing roller gear.

As illustrated in FIG. 3, a collar 33 having a cylindrical shape is positioned at the one end portion of the developing roller shaft 32 in the first direction. The one end portion of the developing roller shaft 32 in the first direction is positioned in the collar 33. The collar 33 is electrically connected to the developing roller 30. The collar 33 has one end face and another end face in the first direction. The collar 33 has an elastic member accommodating portion 33*a*. The elastic member accommodating portion 33*a* has a cylindrical shape and is recessed from the other end face in the first direction toward one side from another side. The elastic member accommodating portion 33*a* has a bottom portion 33*b*.

The developing roller shaft 32 has a retaining ring 34. The one end portion of the developing roller shaft 32 in the first direction is fitted with the retaining ring 34. The retaining ring 34 is positioned further in the first direction toward the other side from the one side than the collar 33.

The developing roller shaft 32 includes an elastic member 35. The elastic member 35 is a coil spring formed by helically winding a metal wire. The elastic member 35 has one end connected to the bottom portion 33*b* of the elastic member accommodating portion 33*a*. The elastic member 35 has another end connected to the retaining ring 34.

The developing roller shaft 32 may not penetrate the roller body 31 in the first direction. For example, the developing roller shaft 32 may extend in the first direction from each end of the roller body 31 in the first direction.

As illustrated in FIG. 2, the developing cartridge 1 includes a gear portion 40. The gear portion 40 is positioned at the first outer surface 11 of the casing 10. The gear portion 40 includes a coupling 41, the developing roller gear, and a gear cover 43.

The coupling 41 is a rotary body configured to receive a driving force supplied from the image-forming apparatus 100. The coupling 41 is rotatable about a rotation axis extending in the first direction. The coupling 41 has a fixing hole 411 recessed in the first direction. When the drum cartridge 2 in a state where the developing cartridge 1 is attached thereto is attached in the main body 9 of the image-forming apparatus 100, a transmission shaft (not illustrated) of the main body 9 is inserted into the fixing hole 411. Hence, the transmission shaft and the coupling 41 are coupled together so as not to rotate relative to each other. Accordingly, when the transmission shaft rotates, the coupling 41 rotates. When the coupling 41 rotates, the developing roller gear rotates. The developing roller 30 also rotates together with the developing roller gear. Further, when the coupling 41 rotates, a supply roller (not illustrated) and an agitator (not illustrated) also rotate.

The casing 10 includes a handle 38 for a user to grip. The handle 38 is positioned at an outer surface at another end portion of the casing 10 in the third direction.

1-3. Outline of Structure of Drum Cartridge

Figure 4:
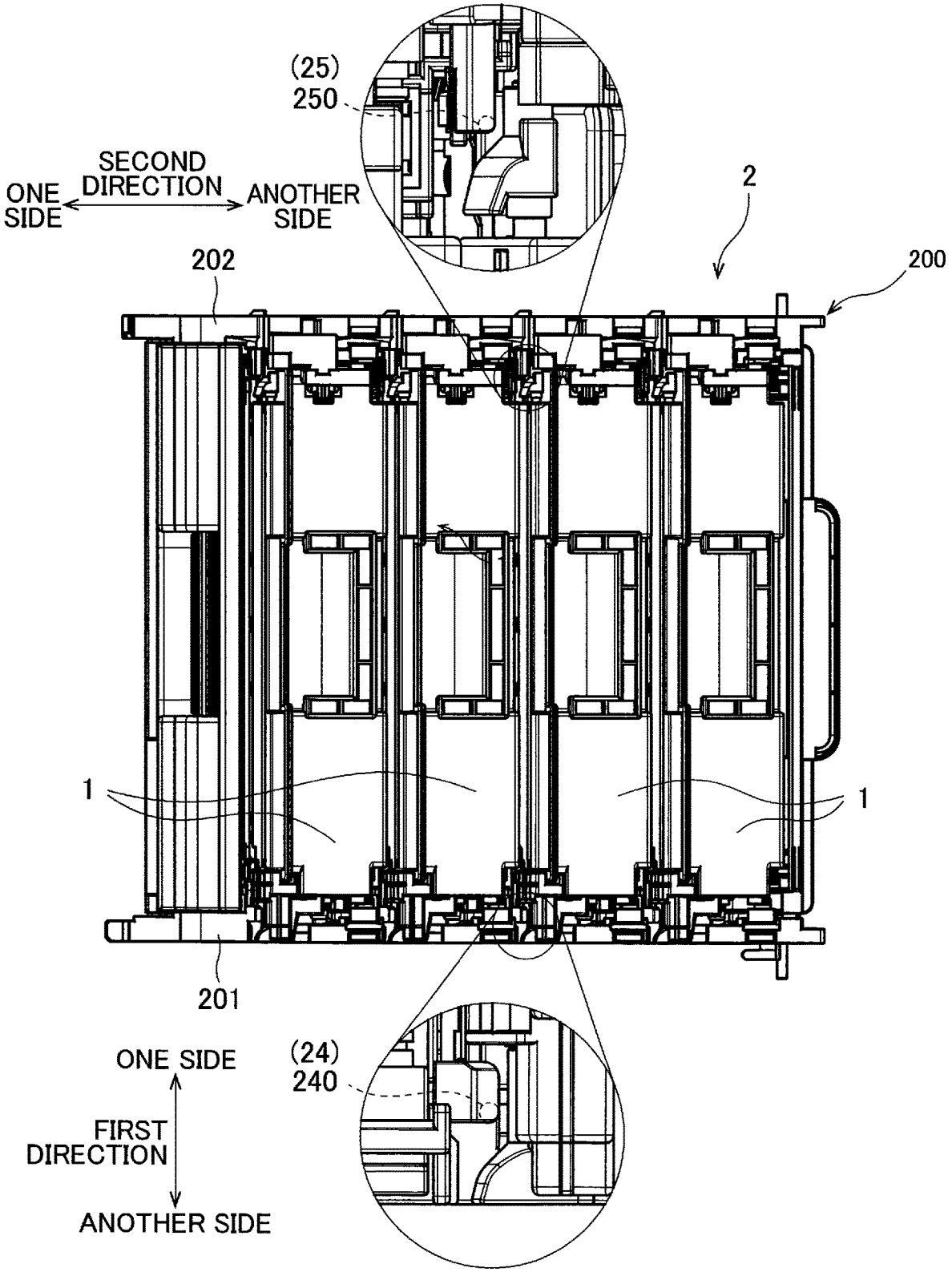
FIG. 4 is a view of the drum cartridge as viewed in a third direction toward one side from another side and illustrates a state where the developing cartridges according to the first embodiment are attached to the drum cartridge.

The structure of the drum cartridge 2 will be outlined while referring to FIGS. 1 and 4. FIG. 4 is a view of the drum cartridge 2 as viewed in the third direction toward one side from another side and illustrates a state where the developing cartridges 1 are attached to the drum cartridge 2. The drum cartridge 2 includes four photosensitive drums 21, and the drum frame 200.

Each of the four photosensitive drums 21 illustrated in FIG. 1 has an outer circumferential surface having a cylindrical shape whose center is a drum axis which is a rotation axis extending in the first direction. The outer circumferential surfaces of the photosensitive drums 21 are coated with photosensitive material. Each of the four photosensitive drums 21 is rotatable about the drum axis.

The drum frame 200 is a frame holding the four photosensitive drums 21. The drum frame 200 holds the photosensitive drums 21 in a state where the photosensitive drums 21 are spaced apart from one another in the second direction. The drum frame 200 includes a pair of side frames 201, 202 facing each other in the first direction. The side frame 202 is positioned in the first direction from the other side toward the one side than the side frame 201. Each photosensitive drum 21 is rotatably supported by the side frames 201 and 202.

In a state where the developing cartridge 1 is attached to the drum frame 200, the one end portion of the developing roller shaft 32 in the first direction faces the side frame 202. Specifically, as illustrated in FIG. 3, the collar 33 positioned at the one end portion of the developing roller shaft 32 in the first direction contacts an inner surface of the side frame 202. The collar 33 is pressed in the direction from the one side toward the other side by the contact between the side frame 202 and one end portion of the collar 33 in the first direction. Hence, the collar 33 moves on the developing roller shaft 32 in the first direction toward the other side from the one side. Accordingly, a distance between the bottom portion 33*b* and the retaining ring 34 is decreased, so that the elastic member 35 falls in a compressed state where its length is smaller than its natural length. Thus, the elastic member 35 urges, through the retaining ring 34, the developing roller shaft 32 in the first direction toward the other side from the one side. Consequently, the first outer surface 11 of the developing cartridge 1 is positioned in the vicinity of the inner surface of the side frame 201. In this way, the position of the developing cartridge 1 in the first direction relative to the drum cartridge 2 is fixed.

For performing a printing process in the image-forming apparatus 100, the controller 102 drives a motor (not illustrated). By the drive of the motor, the photosensitive drum 21 and the developing roller 30 rotate through the transmission shaft and the coupling 41. The controller 102 also supplies electric power to a charger (not illustrated) to charge the outer circumferential surface of the photosensitive drum 21. Further, the controller 102 turns on a light source (not illustrated) to irradiate the outer circumferential surface of the photosensitive drum 21 with the light of the light source. Thus, an electrostatic latent image corresponding to an image to be printed is formed on the outer circumferential surface of the photosensitive drum 21. The developing agent accommodated in the developing cartridge 1 is supplied through the developing roller 30 to the electrostatic latent image formed on the photosensitive drum 21. Thus, the electrostatic latent image becomes a visible developing agent image on the outer circumferential surface of the photosensitive drum 21. Then, the printing sheet is conveyed to a portion between the photosensitive drum 21 and the transfer belt. Hence, the developing agent image is transferred from the outer circumferential surface of the photosensitive drum 21 onto the printing sheet. In a state where the developing agent image is transferred to the printing sheet, the printing sheet is conveyed to a fixing unit (not illustrated) provided in the image-forming apparatus 100. Accordingly, the developing agent image transferred to the printing sheet is thermally fixed to the printing sheet. As a result, the image is printed on the printing sheet.

In the image forming apparatus 100, it is preferable that each of the developing rollers 30 be separated from the corresponding one of the photosensitive drums 21 during switch of printing colors or during a standby period in a printing process. To this end, the image-forming apparatus 100 in the present embodiment has a contacting state and a separated state.

The contacting state is a state where each of the developing rollers 30 is in contact with the corresponding one of the photosensitive drums 21 in a state where the four developing cartridges 1 are attached to the drum cartridge 2. The separated state is a state where each of the developing rollers 30 is separated from the corresponding one of the photosensitive drums 21 in the state where the four developing cartridges 1 are attached to the drum cartridge 2.

To this effect, as components for the contact and the separation, each of the developing cartridges 1 further includes a first cam 61 and a second cam 62. The first cam 61 has a first inclined surface 61*a*. The second cam 62 has a second inclined surface 62*a* and a pressure receiving surface 62*b*. Moreover, as components for the contact and the separation, the drum cartridge 2 includes a first guide roller 24 and a second guide roller 25 for each of the four developing cartridges 1. Furthermore, as components for the contact and the separation, the main body 9 of the image-forming apparatus 100 includes a drive shaft 103 for each of the four developing cartridges 1.

2. Components in Drum Cartridge for Contact and Separation

The components which the drum cartridge 2 includes for performing the contact and the separation will be described while referring to FIGS. 4 through 6.

In a state where the developing cartridge 1 is attached to the drum cartridge 2, the first outer surface 11 of the developing cartridge 1 faces the inner surface of the first side frame 201 in the first direction. In the state where the developing cartridge 1 is attached to the drum cartridge 2, the second outer surface 12 of the developing cartridge 1 faces the inner surface of the second side frame 202 in the first direction.

As indicated by a broken line in an enlarged view depicted in the lower part of FIG. 4, the first side frame 201 includes the first guide roller 24. That is, the first guide roller 24 is positioned at another end portion of the drum frame 200 in the first direction.

Figure 5:
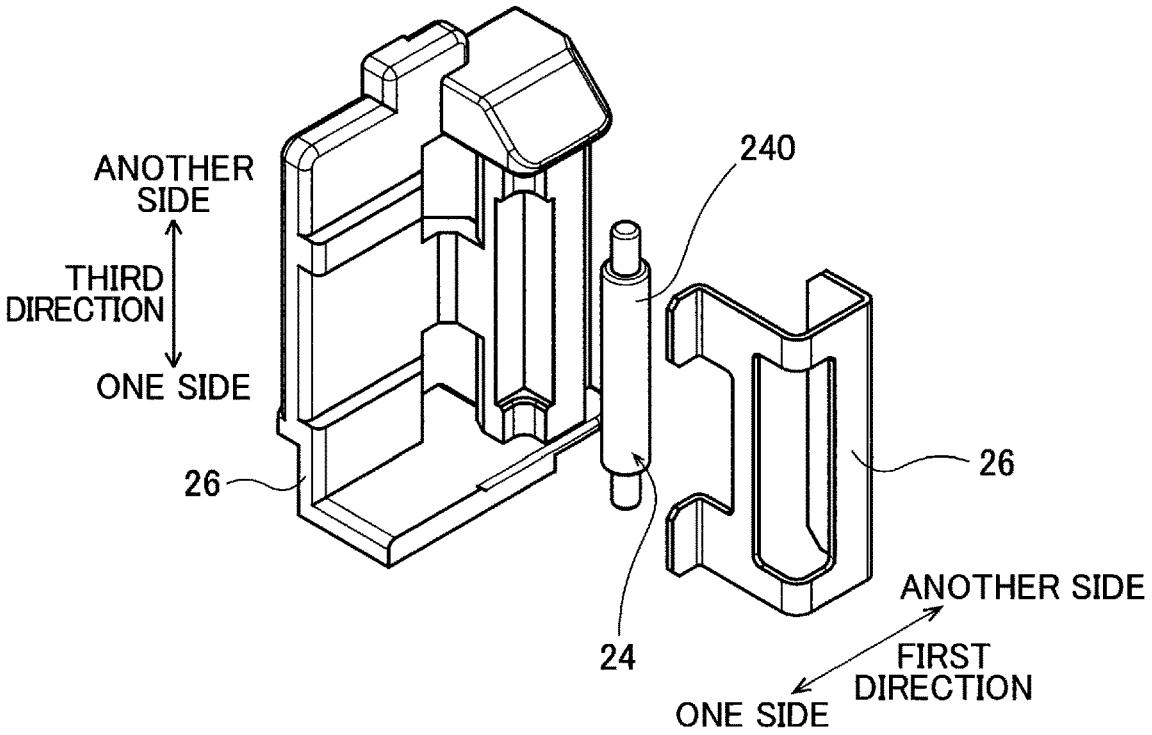
FIG. 5 is an enlarged perspective view of a contact surface (i.e., an outer circumferential surface of a first guide roller)

FIG. 5 is an exploded perspective view illustrating the first guide roller 24 and a bearing portion 26 supporting the first guide roller 24. As illustrated in FIG. 5, the first guide roller 24 has an outer circumferential surface (a contact surface) 240 having a cylindrical shape extending in the third direction. Each end portion of the first guide roller 24 in the third direction is rotatably supported by the bearing portion 26. Hence, the first guide roller 24 is rotatable about its center axis extending in the third direction.

As indicated by a broken line in an enlarged view depicted in the upper part of FIG. 4, the second side frame 202 includes the second guide roller 25. That is, the second guide roller 25 is positioned at one end portion of the drum frame 200 in the first direction.

Figure 6:
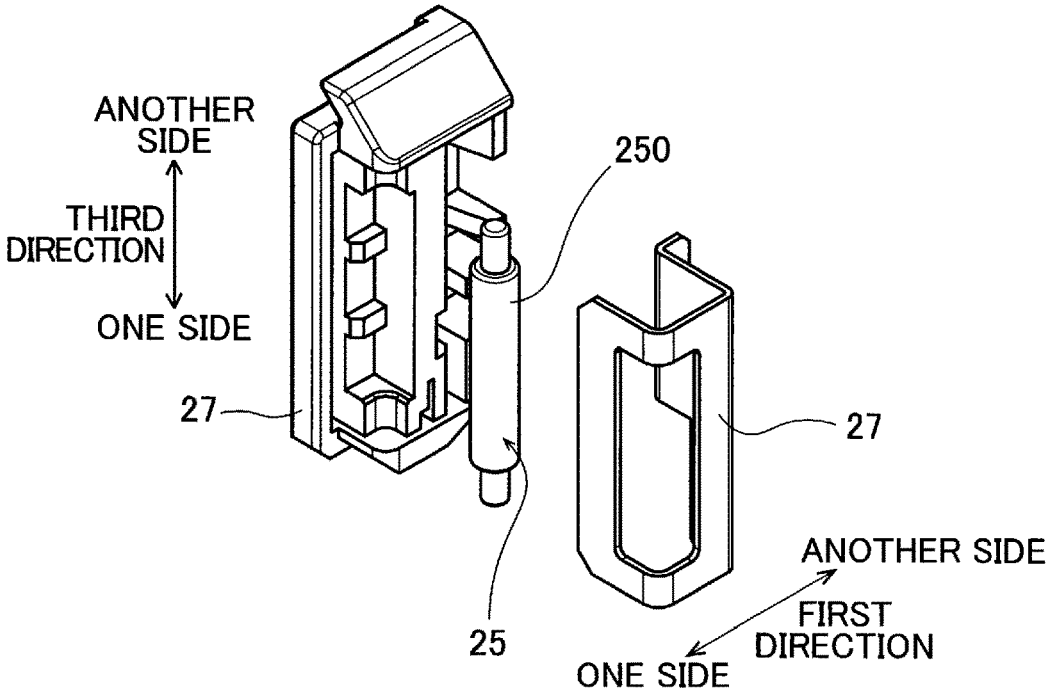
FIG. 6 is an enlarged perspective view of a contact surface (i.e., an outer circumferential surface of a second guide roller)

FIG. 6 is an exploded perspective view illustrating the second guide roller 25 and a bearing portion 27 supporting the second guide roller 25. As illustrated in FIG. 6, the second guide roller 25 has an outer circumferential surface (a contact surface) 250 having a cylindrical shape extending in the third direction. Each end portion of the second guide roller 25 in the third direction is rotatably supported by the bearing portion 27. Hence, the second guide roller 25 is rotatable about its center axis extending in the third direction.

The first guide roller 24 and the second guide roller 25 are positioned so as to function as a roller pair in the first direction. As described later, the second inclined surface 62*a* of the second cam 62 is contactable with the outer circumferential surface 240 of the first guide roller 24, and the first inclined surface 61*a* of the first cam 61 is contactable with the outer circumferential surface 250 of the second guide roller 25.

3. Components in Main Body for Contact and Separation

The components which the main body 9 of the image-forming apparatus 100 includes for performing the contact and the separation will be described while referring to FIGS. 7 and 8. The main body 9 of the image-forming apparatus 100 includes the drive shaft 103 for each of the four developing cartridges 1. The drive shaft 103 is a solid cylinder or solid prismatic column extending in the first direction. The drive shaft 103 advances and retracts in the first direction by receiving a driving force from the main body 9.

4. Components in Developing Cartridge for Contact and Separation

Figure 8:
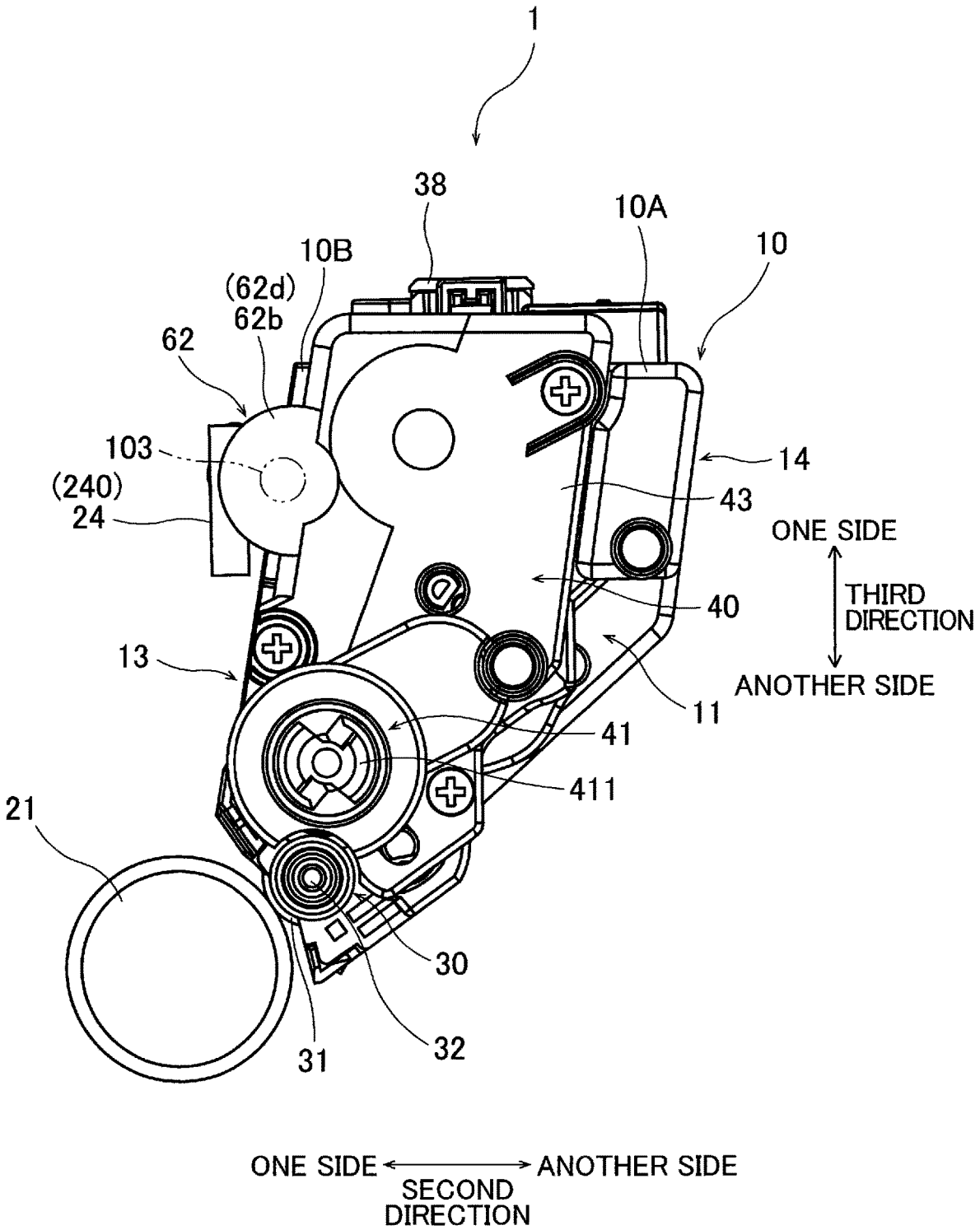
FIG. 8 is a view of the developing cartridge and the photosensitive drum in the contacting state as viewed in the first direction toward one side from another side in the first embodiment.
Figure 9:
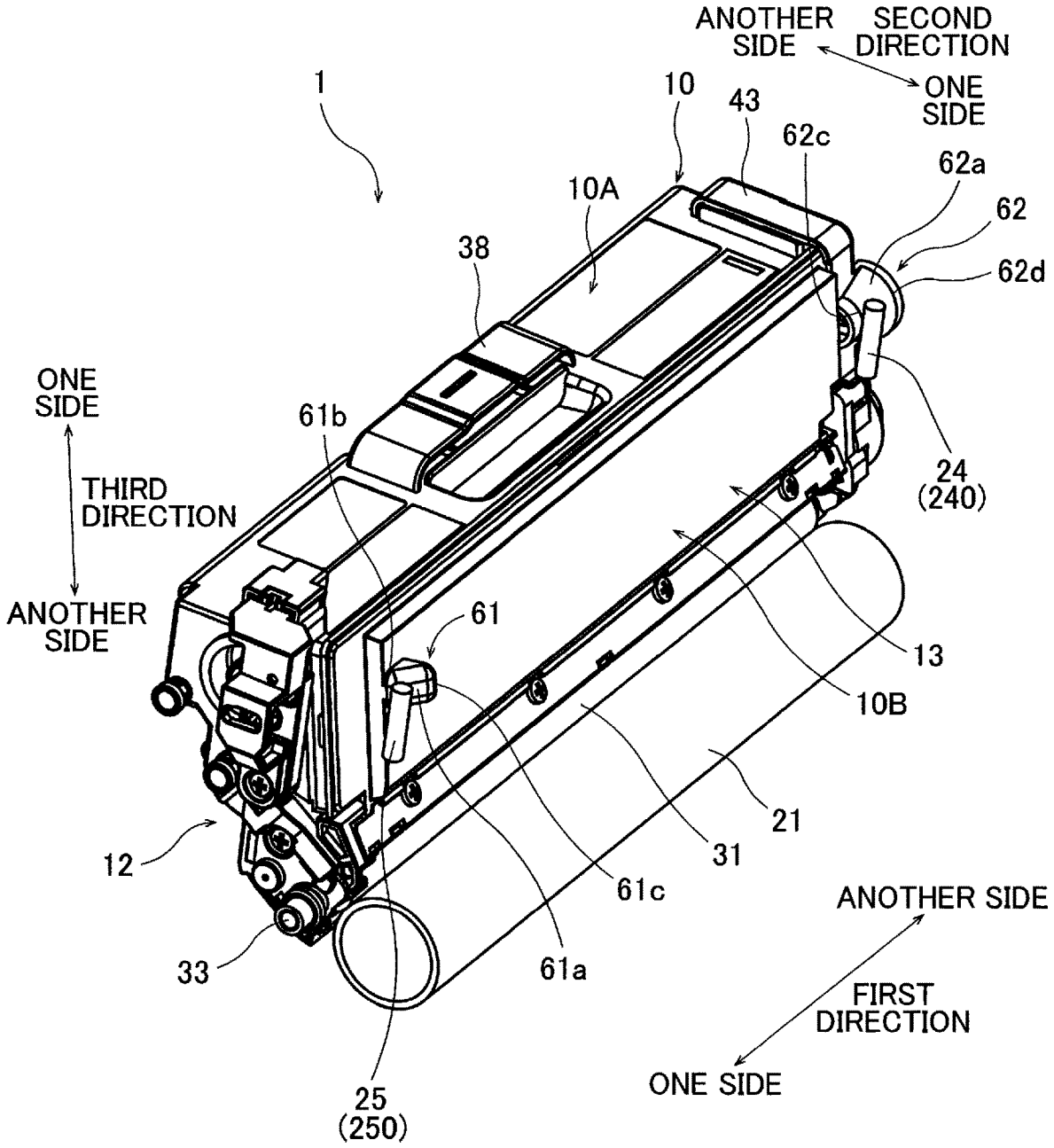
FIG. 9 is a perspective view of the developing cartridge and the photosensitive drum in the contacting state in the first embodiment.

The components which the developing cartridge 1 includes for performing the contact and the separation will be described while referring to FIGS. 2 and 7 through 9. FIG. 7 is a view of the developing cartridge 1 and the photosensitive drum 21 in the contacting state as viewed in the third direction from the other side toward the one side in the present embodiment. FIG. 8 is a view of the developing cartridge 1 and the photosensitive drum 21 in the contacting state as viewed in the first direction from the other side toward the one side in the present embodiment. FIG. 9 is a perspective view of the developing cartridge 1 and the photosensitive drum 21 in the contacting state in the present embodiment.

Figure 7:
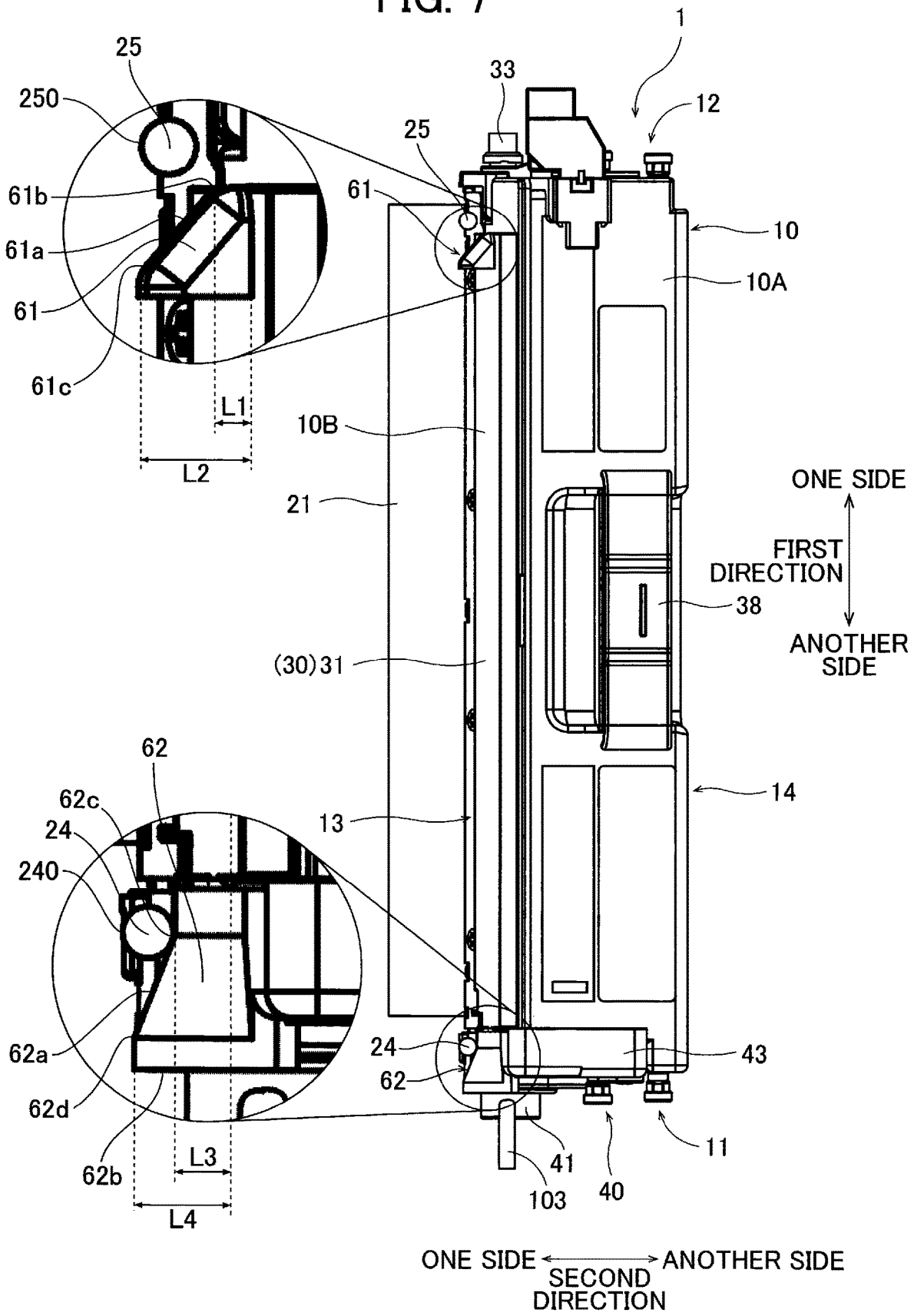
FIG. 7 is a view of the developing cartridge and the photosensitive drum in a contacting state as viewed in the third direction toward the one side from the other side in the first embodiment.

The first cam 61 illustrated in FIGS. 7 and 9 has a right-angled triangular prism shape. The first cam 61 has the first inclined surface 61*a*. The first inclined surface 61*a* is positioned at the third outer surface 13 of the one end portion of the casing 10 in the second direction. The first inclined surface 61*a* is fixed to the casing 10. The first inclined surface 61*a* is inclined relative to the first direction.

Specifically, the first inclined surface 61*a* has one end edge 61*b* and another end edge 61*c* in the first direction. A distance in the second direction between the one end edge

61*b* of the first inclined surface 61*a* and the third outer surface 13 (specifically, the outer surface of the lid 10B) of the one end portion of the casing 10 in the second direction is defined as a first distance L1. A distance in the second direction between the other end edge 61*c* of the first inclined surface 61*a* and the third outer surface 13 (specifically, the outer surface of the lid 10B) of the one end portion of the casing 10 in the second direction is defined as a second distance L2. The first distance L1 is smaller than the second distance L2 (L1<L2). That is, the first inclined surface 61*a* is inclined so as to be distant in the second direction from the third outer surface 13 (specifically, the outer surface of the lid 10B) of the one end portion of the casing 10 in the second direction as extending from the one end edge 61*b* of the first inclined surface 61*a* to the other end edge 61*c* of the first inclined surface 61*a*.

In a state where the developing cartridge 1 is attached to the drum cartridge 2, the first inclined surface 61*a* is movable together with the casing 10 and the developing roller 30 in the first direction relative to the photosensitive drum 21 between a first position and a second position.

The second cam 62 illustrated in FIGS. 7 and 9 has a semi-frustoconical shape. The second cam 62 has the second inclined surface 62*a*. The second inclined surface 62*a* is positioned at the third outer surface 13 of the one end portion of the casing 10 in the second direction. The second inclined surface 62*a* is fixed to the casing 10. The second inclined surface 62*a* is inclined relative to the first direction.

Specifically, the second inclined surface 62*a* has one end edge 62*c* and another end edge 62*d* in the first direction. A distance in the second direction between the one end edge 62*c* of the second inclined surface 62*a* and the third outer surface 13 (specifically, the outer surface of the lid 10B) of the one end portion of the casing 10 in the second direction is defined as a third distance L3. A distance in the second direction between the other end edge 62*d* of the second inclined surface 62*a* and the third outer surface 13 (specifically, the outer surface of the lid 10B) of the one end portion of the casing 10 in the second direction is defined as a fourth distance L4. The third distance L3 is smaller than the fourth distance L4 (L3<L4). That is, the second inclined surface 62*a* is inclined so as to be distant in the second direction from the third outer surface 13 (specifically, the outer surface of the lid 10B) of the one end portion of the casing 10 in the second direction as extending from the one end edge 62*c* of the second inclined surface 62*a* to the other end edge 62*d* of the second inclined surface 62*a*.

In a state where the developing cartridge 1 is attached to the drum cartridge 2, the second inclined surface 62*a* is movable together with the casing 10 and the developing roller 30 in the first direction relative to the photosensitive drum 21 between a third position and a fourth position.

The second cam 62 has the pressure receiving surface 62*b*. The pressure receiving surface 62*b* is positioned at the first outer surface 11 of the casing 10. The pressure receiving surface 62*b* is fixed to the gear cover 43. The pressure receiving surface 62*b* is a flat surface perpendicular to the first direction.

The second inclined surface 62*a* and the pressure receiving surface 62*b* are different surfaces from each other in the outer surface of the second cam 62.

Figure 10:
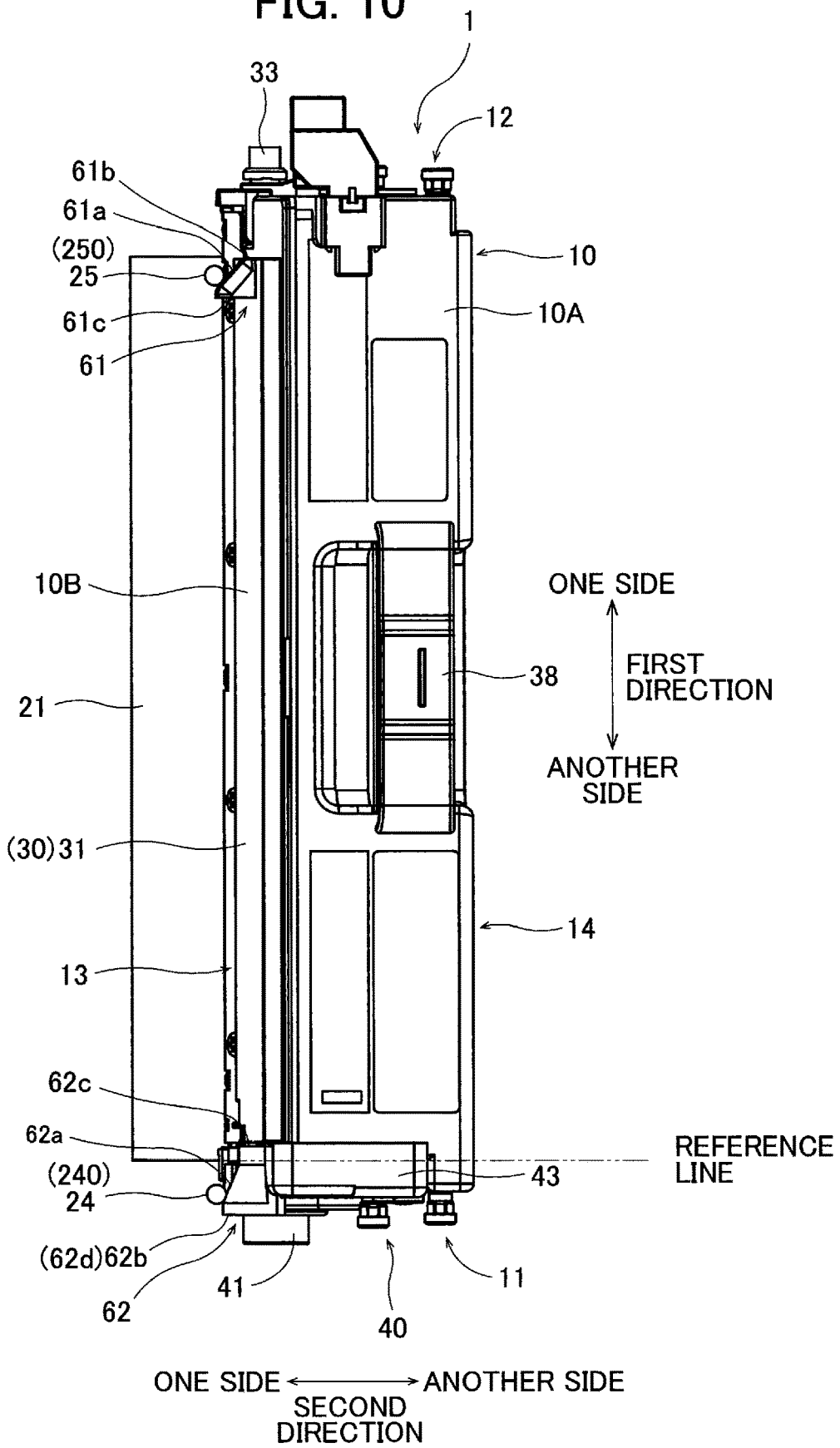
FIG. 10 is a view of the developing cartridge and the photosensitive drum in a separated state as viewed in the third direction toward the one side from the other side in the first embodiment.
Figure 11:
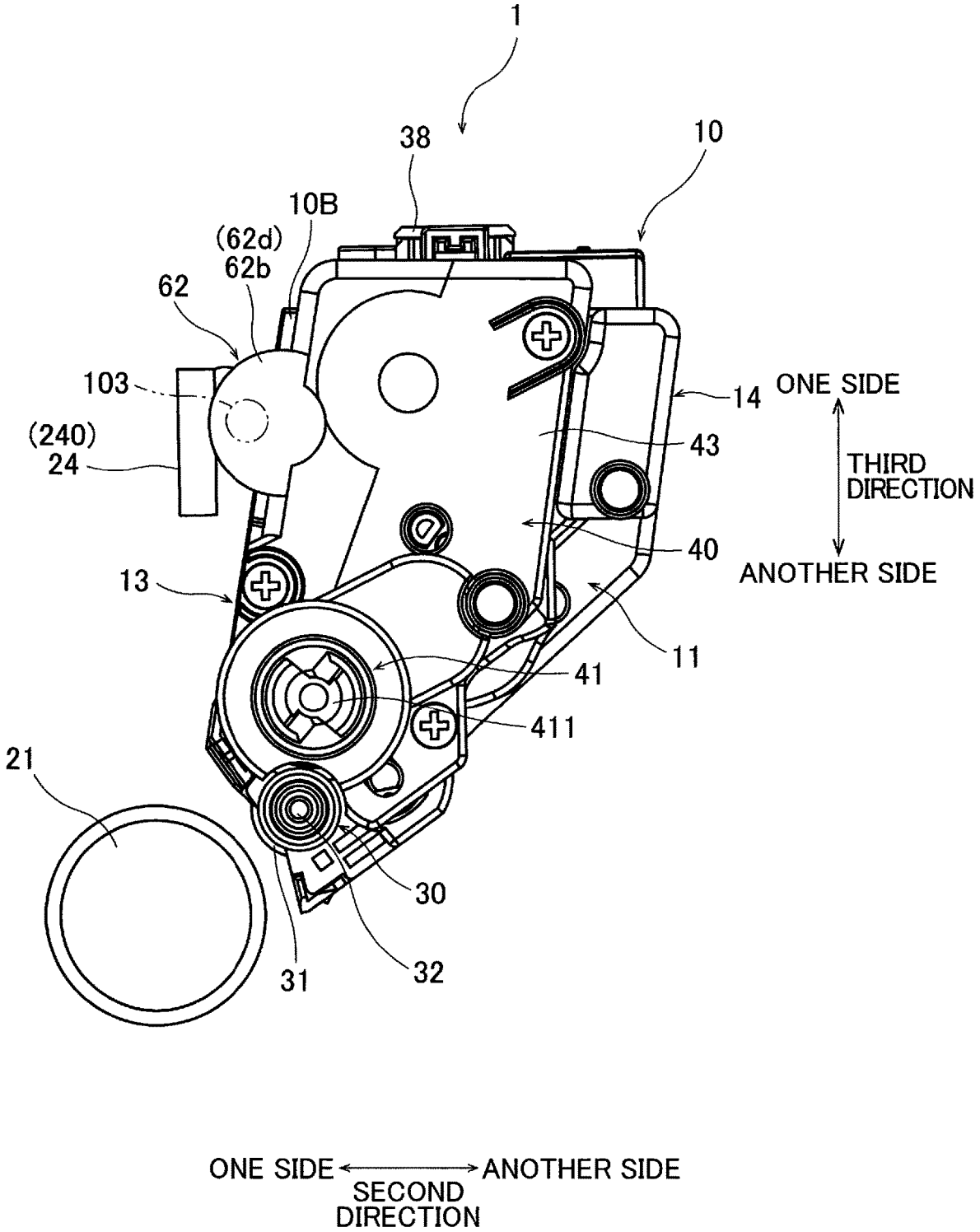
FIG. 11 is a view of the developing cartridge and the photosensitive drum in the separated state as viewed in the first direction toward the one side from the other side in the first embodiment.
Figure 12:
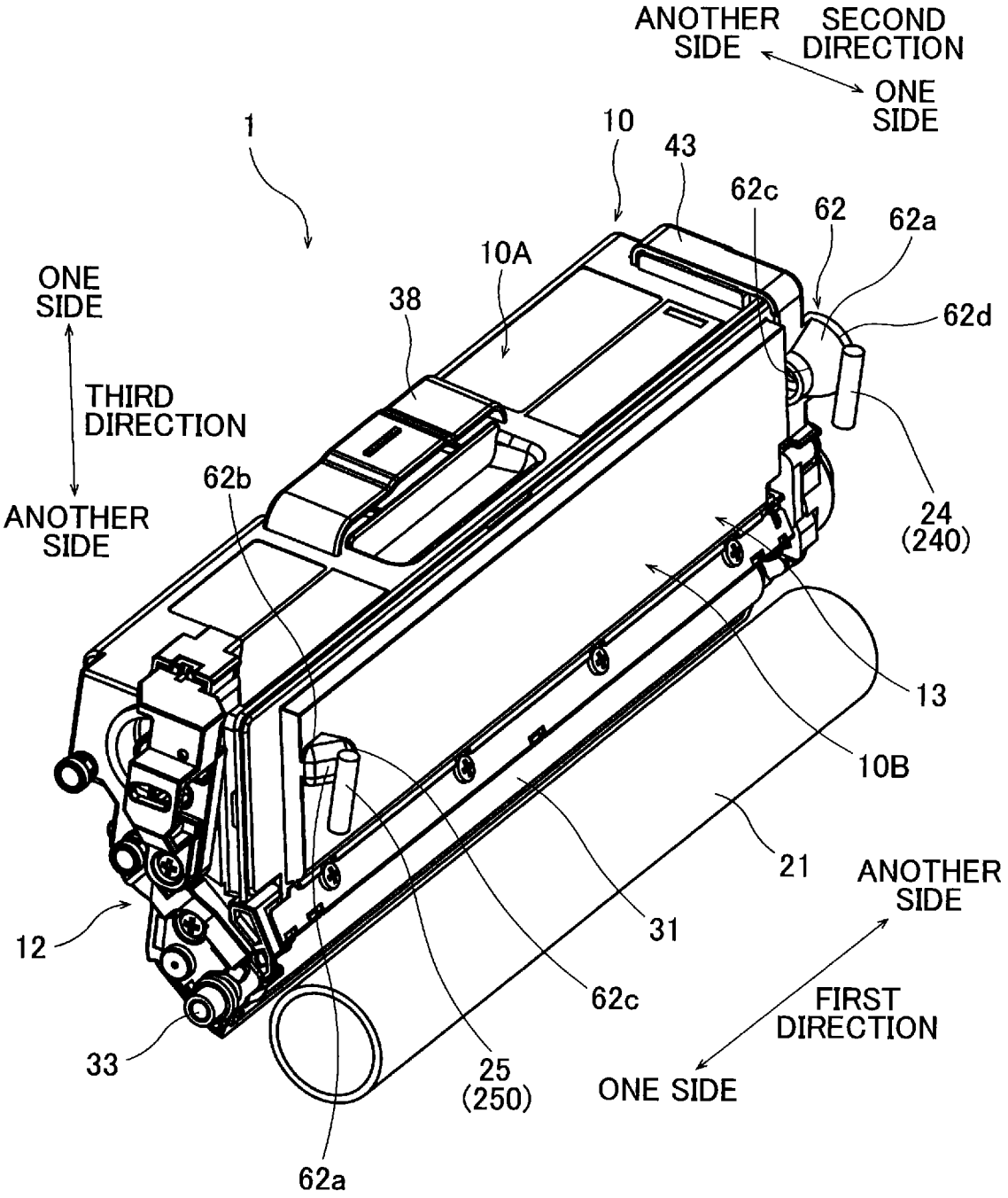
FIG. 12 is a perspective view of the developing cartridge and the photosensitive drum in the separated state in the first embodiment.

5. Movement of Each Component at the Time of Switching Between Contacting State and Separated State Movement of each component for the contact and the separation at the time of switching the state of the image-forming apparatus 100 between the contact state and the separated state will be described while referring to FIGS. 7 to 12. FIG. 10 is a view of the developing cartridge 1 and the photosensitive drum 21 in the separated state as viewed in the third direction from the other side toward the one side in the present embodiment. FIG. 11 is a view of the developing cartridge 1 and the photosensitive drum 21 in the separated state as viewed in the first direction from the other side toward the one side in the present embodiment. FIG. 12 is a perspective view of the developing cartridge 1 and the photosensitive drum 21 in the separated state in the present embodiment.

In the image-forming apparatus 100, the pressure receiving surface 62*b* of the second cam 62 is pressed by the drive shaft 103 when the drive shaft 103 is driven to advance in a direction from the other end portion of the casing 10 in the first direction toward the one end portion of the casing 10 in the first direction. Hence, the pressure receiving surface 62*b* receives the pressing force directed from the other end portion of the casing 10 in the first direction toward the one end portion of the casing 10 in the first direction. Here, the pressure receiving surface 62*b*, the first inclined surface 61*a*, and the second inclined surface 62*a* are fixed to the casing 10. Therefore, when the pressure receiving surface 62*b* receives the pressing force, the first inclined surface 61*a* moves in the first direction from the first position illustrated in FIGS. 7 and 9 to the second position illustrated in FIGS. 10 and 12. Further, when the pressure receiving surface 62*b* receives the pressing force, the second inclined surface 62*a* moves in the first direction from the third position illustrated in FIGS. 7 and 9 to the fourth position illustrated in FIGS. 10 and 12.

In a process of the movement of the first inclined surface 61*a* from the first position to the second position, the first inclined surface 61*a* contacts the outer circumferential surface 250 of the second guide roller 25 of the drum cartridge 2. In accordance with the movement of the first inclined surface 61*a* from the first position to the second position, the contacting position between the first inclined surface 61*a* and the second guide roller 25 gradually shifts on the first inclined surface 61*a* from a position close to the one end edge 61*b* to a position close to the other end edge 61*c*. Hence, a distance in the second direction between the outer surface of the lid 10B and the contacting position at which the first inclined surface 61*a* and the second guide roller 25 are in contact with each other gradually increases as the first inclined surface 61*a* approaches the second position from the first position. As a result, since the first inclined surface 61*a* is pressed by the second guide roller 25, the casing 10 and the developing roller 30 gradually move together with the first cam 61 relative to the photosensitive drum 21 in the second direction from one side toward another side.

In a process of the movement of the second inclined surface 62*a* from the third position to the fourth position, the second inclined surface 62*a* contacts the outer circumferential surface 240 of the first guide roller 24 of the drum cartridge 2. In accordance with the movement of the second inclined surface 62*a* from the third position to the fourth position, the contacting position between the second inclined surface 62*a* and the first guide roller 24 gradually shifts on the second inclined surface 62*a* from a position close to the one end edge 62*c* to a position close to the other end edge 62*d*. Hence, a distance in the second direction between the outer surface of the lid 10B and the contacting position at which the second inclined surface 62*a* and the first guide roller 24 are in contact with each other gradually increases as the second inclined surface 62*a* approaches the fourth position from the third position. As a result, since the second inclined surface 62*a* is pressed by the first guide roller 24, the casing 10 and the developing roller 30 gradually move together with the second cam 62 relative to the photosensitive drum 21 in the second direction from the one side toward the other side.

As described above, since the first inclined surface 61*a* is pressed by the second guide roller 25, the one end portions of the casing 10 and the developing roller 30 in the first direction are pushed out relative to the photosensitive drum 21 in the second direction from the one side toward the other side. Further, since the second inclined surface 62*a* is pressed by the first guide roller 24, the other end portions of the casing 10 and the developing roller 30 in the first direction are pushed out relative to the photosensitive drum 21 in the second direction from the one side toward the other side. As a result, the developing roller 30 can be separated from the photosensitive drum 21 while the developing cartridge 1 can be prevented from being inclined relative to the first direction.

That is, the developing roller 30 is in contact with the photosensitive drum 21 when the first inclined surface 61*a* is at the first position and the second inclined surface 62*a* is at the third position. The developing roller 30 is in separation from the photosensitive drum 21 when the first inclined surface 61*a* is at the second position and the second inclined surface 62*a* is at the fourth position. Here, as illustrated in FIGS. 8 and 11, the pressure receiving surface 62*b* is overlapped with the drive shaft 103 in the first direction in both cases where the first inclined surface 61*a* is at the first position and at the second position. In other words, the pressure receiving surface 62*b* is overlapped with the drive shaft 103 as viewed in the first direction both when the first inclined surface 61*a* is at the first position and when the first inclined surface 61*a* is at the second position. Further, the pressure receiving surface 62*b* is a flat surface perpendicular to the first direction. Hence, the pressure receiving surface 62*b* can be slidingly moved relative to the drive shaft 103. As a result, shift from the contacting state to the separated state can be continuously and smoothly performed in the image-forming apparatus 100.

In the image-forming apparatus 100, when the drive shaft 103 is retracted in a direction from the one end portion of the casing 10 in the first direction toward the other end portion of the casing 10 in the first direction, the first outer surface 11 of the developing cartridge 1 is pressed against the inner surface of the side frame 201 by the urging force of the elastic member 35 illustrated in FIG. 3 Hence, the first inclined surface 61*a* moves from the second position to the first position in the first direction, and the second inclined surface 62*a* moves from the fourth position to the third position in the first direction.

Here, the drum frame 200 of the drum cartridge 2 includes a pressure mechanism (not illustrated) for pressing the casing 10 of the developing cartridge 1 in a direction toward the photosensitive drum 21. The developing cartridge 1 is pushed by the pressure mechanism in the second direction from the other side toward the one side, so that the contacting state where the developing roller 30 and the photosensitive drum 21 is in contact with each other is restored. In this way, the state of the image-forming apparatus 100 is switched between the contacting state (FIGS. 6 through 8) and the separated state (FIGS. 9 through 11).

6. Summary of First Embodiment

As described above, the developing cartridge 1 according to the first embodiment includes the casing 10, the developing roller 30, and the first inclined surface 61*a*. As illustrated in FIGS. 7 through 9, in the developing cartridge 1 according to the present embodiment, the developing roller 30 is in contact with the photosensitive drum 21 in a state where the first inclined surface 61*a* is at the first position. As illustrated in FIGS. 10 through 12, in the developing cartridge 1 according to the present embodiment, the developing roller 30 is in separation from the photosensitive drum 21 in a state where the first inclined surface 61*a* is at the second position. Hence, in a process of movement of the first inclined surface 61*a* from the first position to the second position, the first inclined surface 61*a* is pressed by the outer circumferential surface (contact surface) 250 of the second guide roller 25 of the drum cartridge 2, so that the developing roller 30 can be separated from the photosensitive drum 21.

In this way, in the developing cartridge 1 according to the present embodiment, the developing roller 30 and the photosensitive drum 21 can be separated from each other by application of a driving force only to one side in the first direction of the developing cartridge 1, without necessitating application of a driving forces to each side of the developing cartridge 1.

Further, in the developing cartridge 1 according to the present embodiment, the first distance L1 is smaller than the second distance L2 (L1<L2). Hence, in a process of movement of the first inclined surface 61*a* from the first position to the second position, the first inclined surface 61*a* is gradually pressed in the second direction from the one side toward the other side, so that the developing roller 30 can be separated from the photosensitive drum 21.

The developing cartridge 1 according to the present embodiment further includes the second inclined surface 62*a*. As illustrated in FIGS. 7 through 9, in the developing cartridge 1 according to the present embodiment, in a state where the first inclined surface 61*a* is at the first position, the second inclined surface 62*a* is at the third position and the developing roller 30 is in contact with the photosensitive drum 21. As illustrated in FIGS. 10 through 12, in the developing cartridge 1 according to the present embodiment, in a state where the first inclined surface 61*a* is at the second position, the second inclined surface 62*a* is at the fourth position and the developing roller 30 is in separation from the photosensitive drum 21. Accordingly, in a process in which the first inclined surface 61*a* moves from the first position to the second position and the second inclined surface 62*a* moves from the third position to the fourth position, the first inclined surface 61*a* and the second inclined surface 62*a* are pressed by the outer circumferential surface 250 (contact surface) of the second guide roller 25 and the outer circumferential surface 240 (contact surface) of the first guide roller 24, respectively. As a result, the developing roller 30 can be separated from the photosensitive drum 21. Since the first inclined surface 61*a* and the second inclined surface 62*a* are positioned away from each other in the first direction, the end portions of the casing 10 in the first direction can be pressed by the outer circumferential surfaces 240 and 250 of the guide rollers 24 and 25.

Further, in the developing cartridge 1 according to the present embodiment, the third distance L3 is smaller than the fourth distance L4 (L3<L4). Hence, in a process of movement of the second inclined surface 62*a* from the third position to the fourth position, the second inclined surface 62*a* is gradually pressed in the second direction from the one side toward the other side, so that the developing roller 30 can be separated from the photosensitive drum 21.

The developing cartridge 1 according to the present embodiment further includes the pressure receiving surface 62*b*. Hence, by the pressure receiving surface 62*b* being applied with a pressing force, the first inclined surface 61*a* can be moved together with both the casing 10 and the developing roller 30.

Further, in the developing cartridge 1 according to the present embodiment, the first inclined surface 61*a* moves from the first position to the second position when the pressure receiving surface 62*b* receives a pressing force directed from the other end portion of the casing 10 in the first direction toward the one end portion of the casing 10 in the first direction. Here, the pressing force directed from the other end portion to the one end portion of the casing 10 in the first direction is converted to a force directed in the second direction by the contact between the first inclined surface 61*a* and the outer circumferential surface 250 of the second guide roller 25. As a result, the developing roller 30 can be separated from the photosensitive drum 21.

Further, in the present embodiment, the main body 9 includes the drive shaft 103. The first inclined surface 61*a* moves from the first position to the second position when the drive shaft 103 presses the pressure receiving surface 62*b*. Thus, the developing roller 30 can be separated from the photosensitive drum 21 by the driving force applied from the main body 9.

Further, in the developing cartridge 1 according to the present embodiment, the developing roller 30 includes the roller body 31 and the developing roller shaft 32. The developing cartridge 1 according to the present embodiment includes the collar 33 and the elastic member 35. In a state where the drum cartridge 2 is attached to the main body 9 with the developing cartridge 1 attached to the drum cartridge 2, the elastic member 35 urges the developing roller 30 in a direction from the one end portion of the casing 10 in the first direction toward the other end portion of the casing 10 in the first direction. Hence, the first inclined surface 61*a* can be moved from the second position to the first position by the urging force of the elastic member 35. As a result, the developing roller 30 can be moved from a state where the developing roller 30 is in separation from the photosensitive drum 21 to a state where the developing roller 30 is in contact with the photosensitive drum 21.

Further, in the developing cartridge 1 according to the present embodiment, the collar 33 is electrically connected to the developing roller 30. Hence, the collar 33 also functions as an electrode of the developing roller 30, thereby reducing numbers of components.

Further, in the developing cartridge 1 according to the present embodiment, the direction in which the elastic member 35 urges the developing roller 30 is opposite to the direction in which the drive shaft 103 presses the pressure receiving surface 62*b*. Hence, the first inclined surface 61*a* can be moved between the first position and the second position with high accuracy.

Further, in the developing cartridge 1 according to the present embodiment, the first inclined surface 61*a* moves from the second position to the first position by the urging force of the elastic member 35 when a supply of the driving force from the main body 9 to the drive shaft 103 is stopped. Hence, by stopping the supply of the driving force from the main body 9 to the drive shaft 103, the developing roller 30 can be easily shifted from the state where the developing roller 30 is in separation from the photosensitive drum 21 to the state where the developing roller 30 is in contact with the photosensitive drum 21.

Further, in the present embodiment, the drum cartridge 2 includes the second guide roller 25 having the outer circumferential surface 250 which is contactable with the first inclined surface 61*a*. Hence, the first inclined surface 61*a* moves in the first direction while maintaining the contact with the outer circumferential surface 250 of the second guide roller 25, whereby the first inclined surface 61*a* is pressed by the outer circumferential surface 250. As a result, the developing roller 30 can be moved from the state where the developing roller 30 is in contact with the photosensitive drum 21 to the state where the developing roller 30 is in separation from the photosensitive drum 21.

Further, in the present embodiment, the pressure receiving surface 62*b* is the flat surface perpendicular to the first direction. Hence, the pressure receiving surface 62*b* can easily be slidingly moved relative to the drive shaft 103 in the second direction. As a result, the developing roller 30 can be smoothly shifted from the state where the developing roller 30 is in contact with the photosensitive drum 21 to the state where the developing roller 30 is in separation from the photosensitive drum 21.

Further, in the present embodiment, the pressure receiving surface 62*b* is overlapped with the drive shaft 103 in the first direction in both when the first inclined surface 61*a* is at the first position and when the first inclined surface 61*a* is at the second position. In other words, the pressure receiving surface 62*b* is overlapped with the drive shaft 103 as viewed in the first direction in both the two cases. Hence, by slidingly moving the pressure receiving surface 62*b* relative to the drive shaft 103, the state of the developing roller 30 can be continuously shifted between the state where the developing roller 30 is in contact with the photosensitive drum 21 and the state where the developing roller 30 is in separation from the photosensitive drum 21.

Further, in the present embodiment, the second guide roller 25 is rotatable about the rotation axis extending in the third direction. This configuration can reduce frictional force generated between the first inclined surface 61*a* and the outer circumferential surface 250 of the second guide roller 25 when the first inclined surface 61*a* moves in the first direction while contacting the outer circumferential surface 250 of the second guide roller 25.

Second Embodiment

Figure 13:
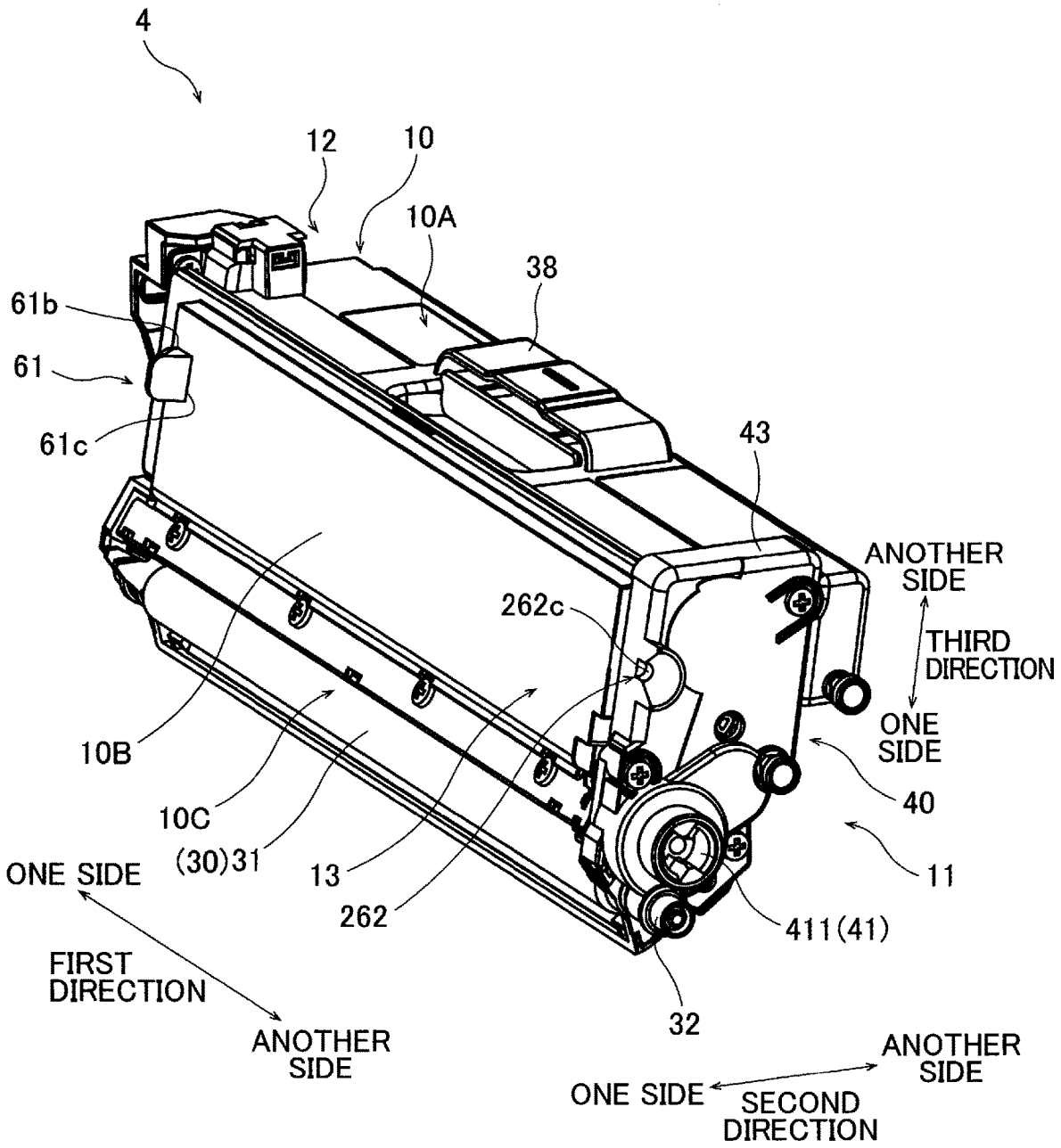
FIG. 13 is a perspective view of a developing cartridge according to a second embodiment.

A developing cartridge 4 according to a second embodiment of the present disclosure will next be described with reference to FIGS. 13 through 19. FIG. 13 is a perspective view of the developing cartridge 4 according to the present embodiment.

The second embodiment mainly differs from the first embodiment in that the developing cartridge 4 has a recess 262 instead of the second cam 62, and in that the drum cartridge 2 does not include the first guide roller 24. In the following description to the second embodiment, like parts and components are designated by the same reference numerals as those shown in the first embodiment to avoid duplicating description.

7. Specific Structure of Second Embodiment

The gear cover 43 of the developing cartridge 4 has the recess 262. The recess 262 is recessed in a direction toward one end portion of the gear cover 43 in the first direction from another end portion of the gear cover 43 in the first direction. The recess 262 has a semi-circular shape as viewed in the first direction from the other side toward the one side. The recess 262 is open toward the one end portion of the casing 10 in the second direction. That is, the recess 262 is positioned at the third outer surface 13 of the one end portion of the casing 10 in the second direction.

The recess 262 has a second inclined surface 262*c* at the opposite side to the open side. That is, the second inclined surface 262*c* is positioned at an inner wall surface of the recess 262. The second inclined surface 262*c* is fixed to the casing 10. The second inclined surface 262*c* is inclined relative to the first direction. The second inclined surface 262*c* is inclined so as to be distant in the second direction from the one side toward the other side from the third outer surface 13 (specifically, the outer surface of the lid 10B) of the one end portion of the casing 10 in the second direction as extending in the first direction from the one side to the other side.

In a state where the developing cartridge 1 is attached to the drum cartridge 2, the second inclined surface 262*c* is movable together with the casing 10 and the developing roller 30 relative to the photosensitive drum 21 between a third position and a fourth position in the first direction and the second direction.

Figure 14:
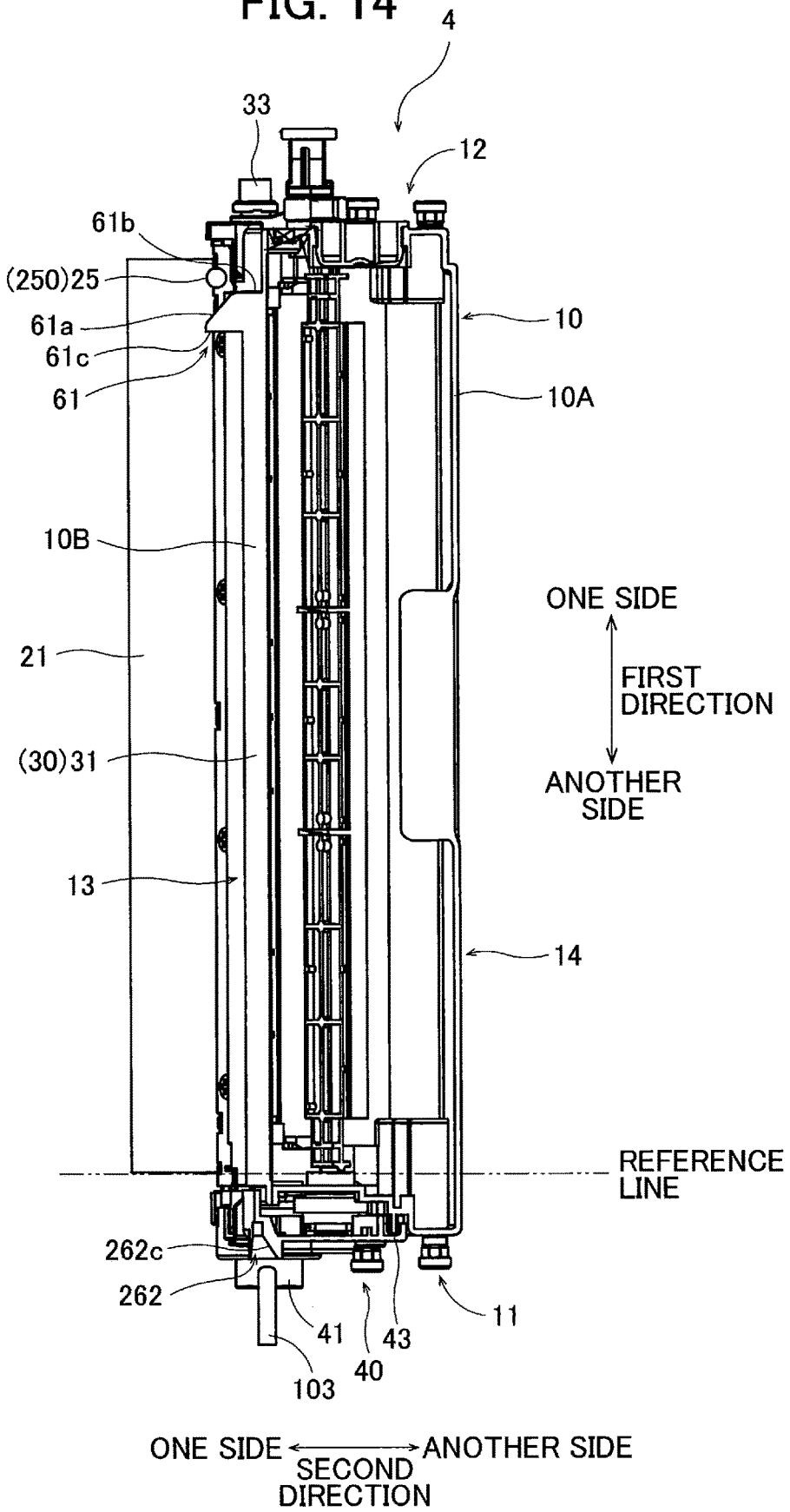
FIG. 14 is a cross-sectional view of the developing cartridge according to the second embodiment in a contacting state, taken along a plane perpendicular to the third direction.
Figure 15:
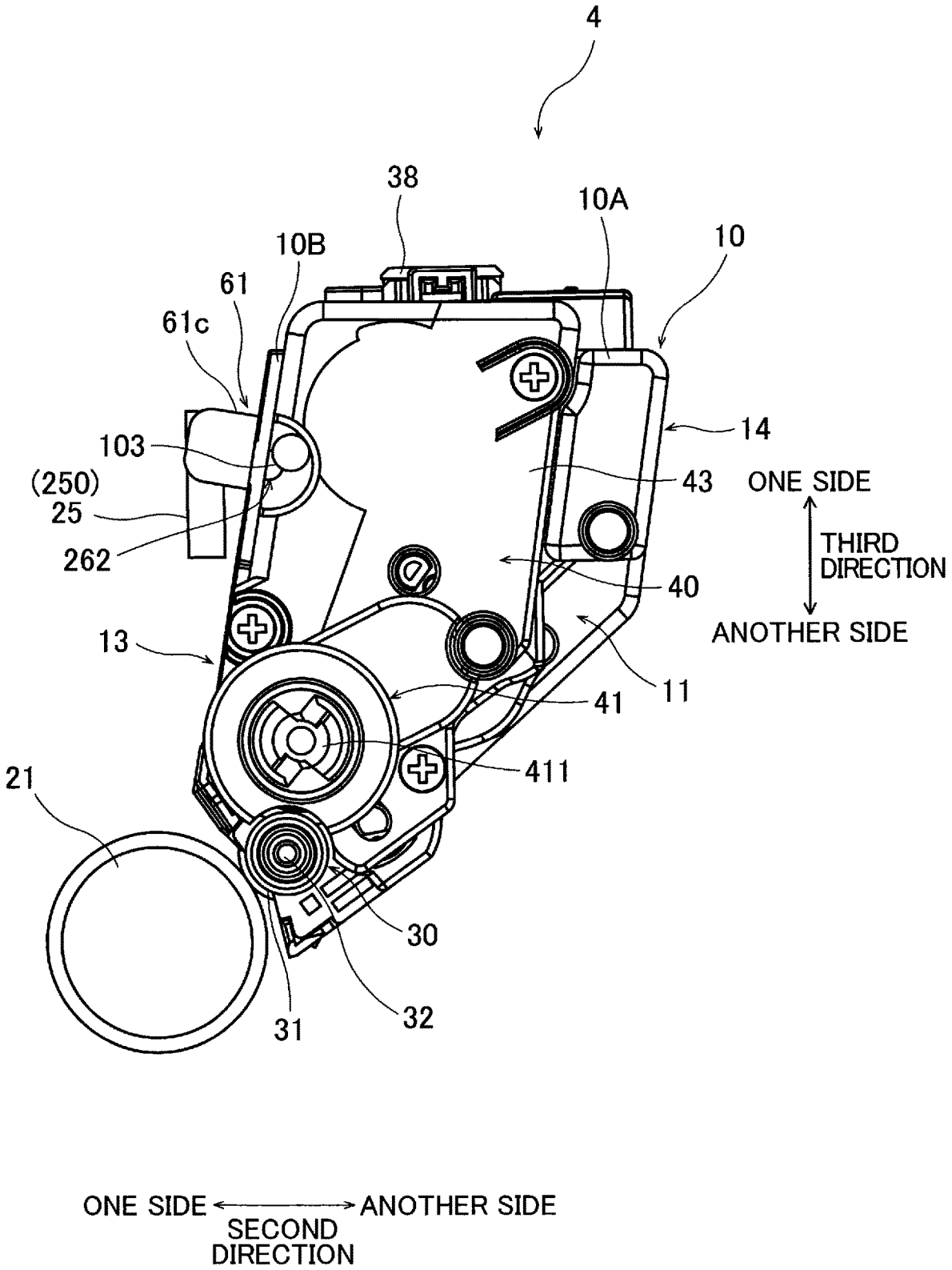
FIG. 15 is a view of the developing cartridge according to the second embodiment in the contacting state as viewed in the first direction from the other side to the one side.
Figure 16:
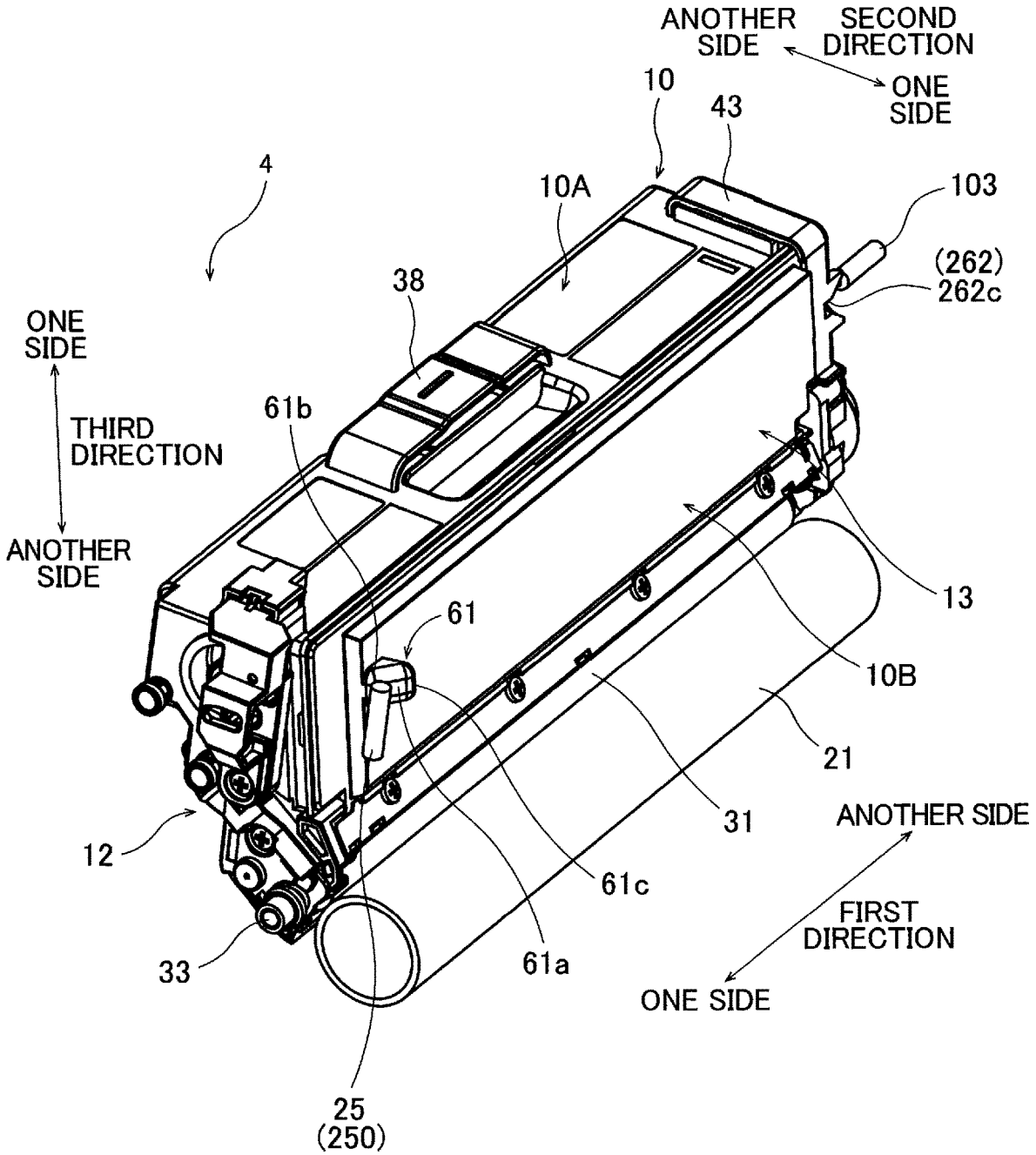
FIG. 16 is a perspective view of the developing cartridge according to the second embodiment in the contacting state.
Figure 17:
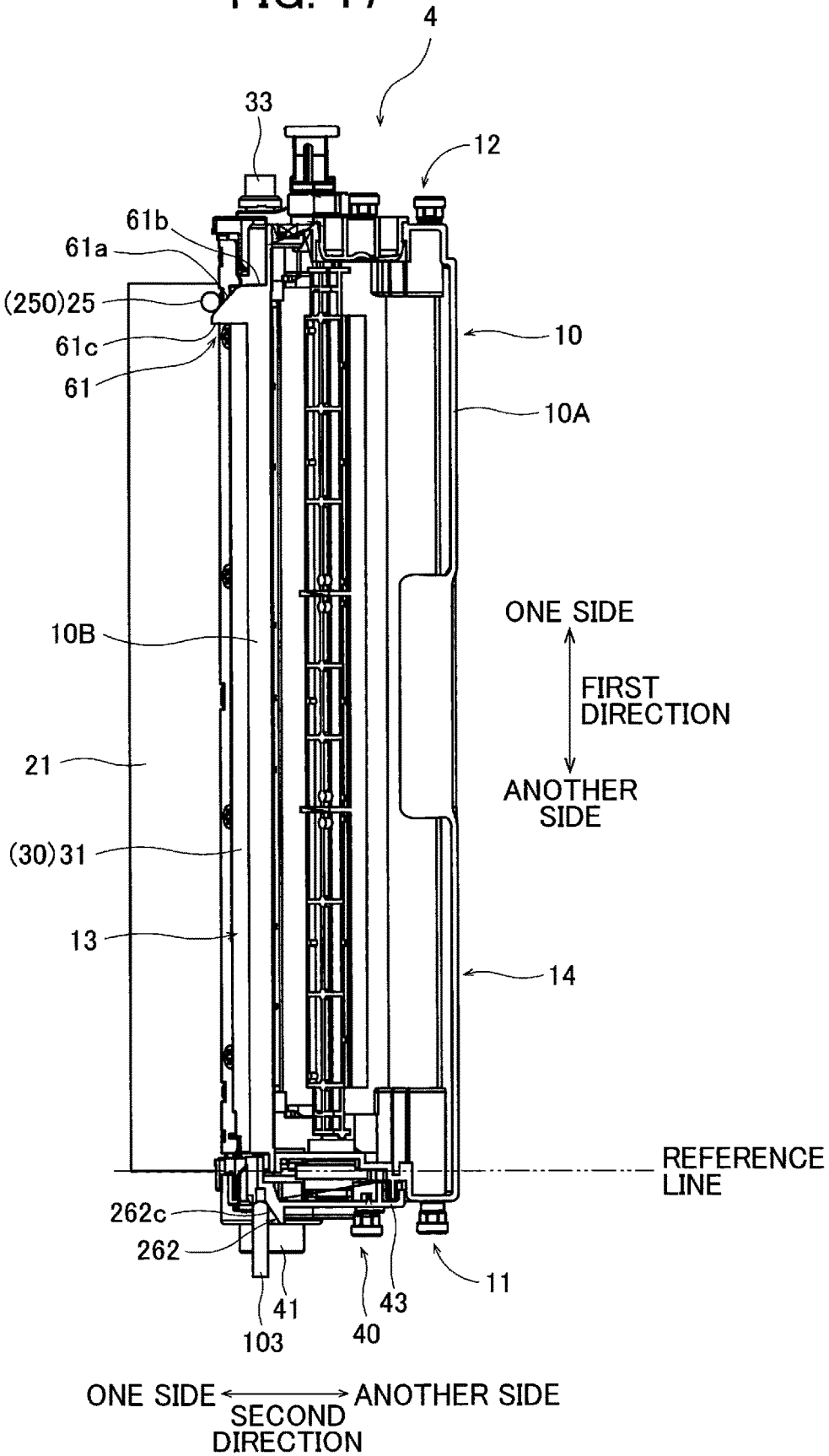
FIG. 17 is a cross-sectional view of the developing cartridge according to the second embodiment in a separated state, taken along a plane perpendicular to the third direction.
Figure 18:
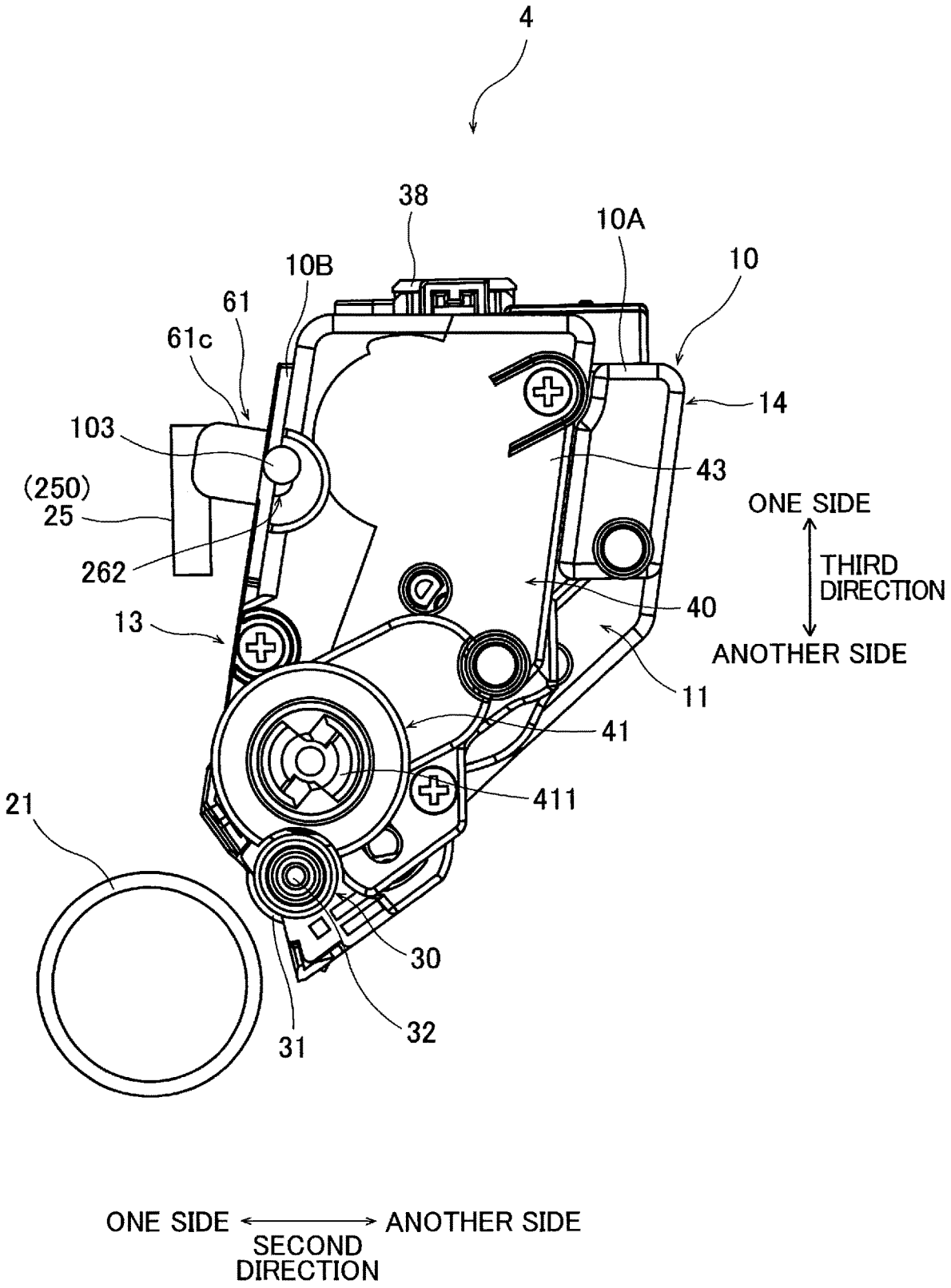
FIG. 18 is a view of the developing cartridge according to the second embodiment in the separated state as viewed in the first direction from the other side to the one side.
Figure 19:
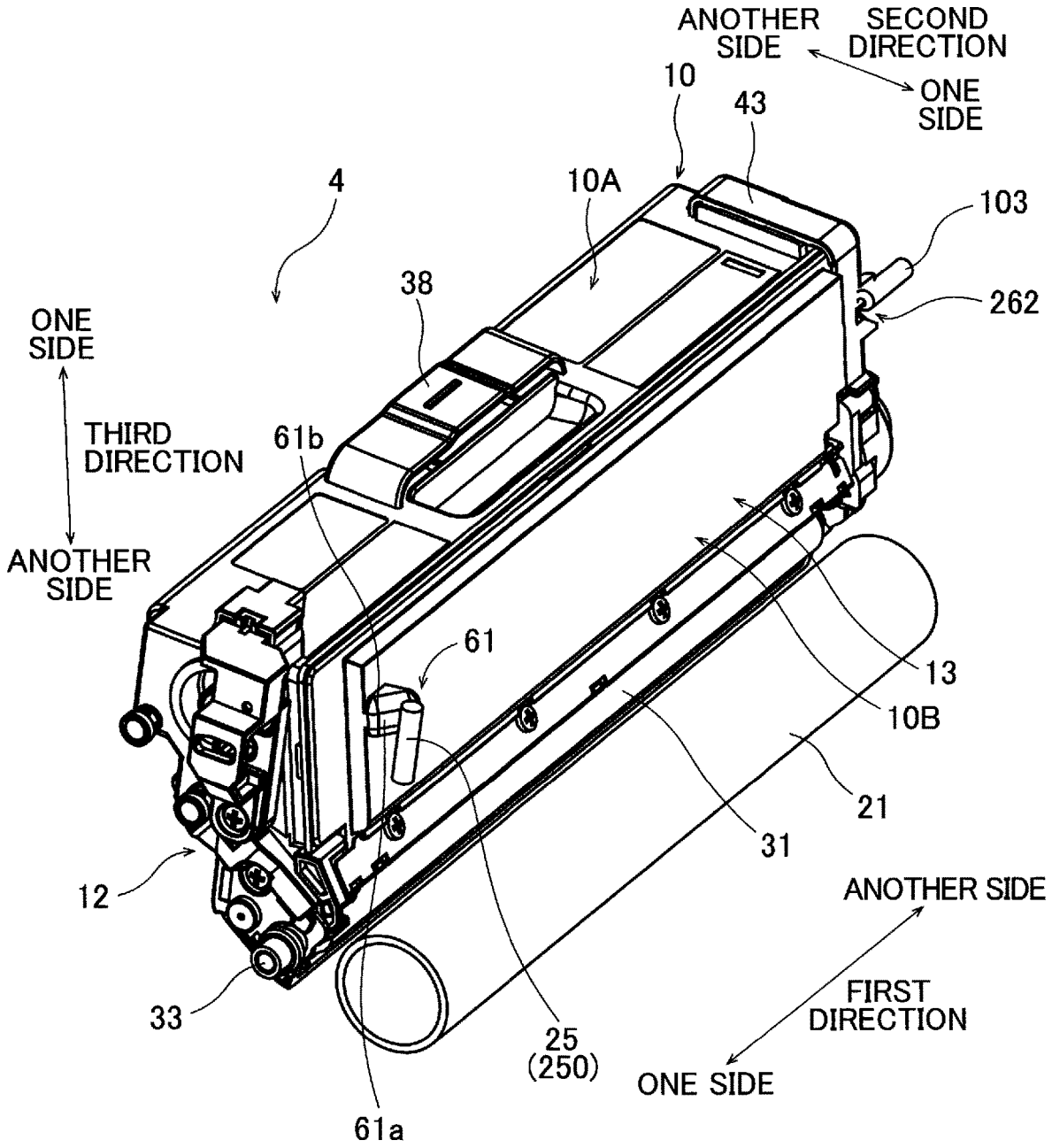
FIG. 19 is a perspective view of the developing cartridge according to the second embodiment in the separated state.

8. Movement of Each Component in Second Embodiment at the Time of Switching Between Contacting State and Separated State Movement of each component for the contact and the separation at the time of switching the state of the image-forming apparatus 100 according to the second embodiment between the contacting state and the separated state will be described while referring to FIGS. 14 to 19. FIG. 14 is a cross-sectional view of the developing cartridge 4 according to the second embodiment in the contacting state, taken along a plane perpendicular to the third direction. FIG. 15 is a view of the developing cartridge 4 according to the second embodiment in the contacting state as viewed in the first direction from the other side toward the one side. FIG. 16 is a perspective view of the developing cartridge 4 according to the second embodiment in the contacting state. FIG. 17 is a cross-sectional view of the developing cartridge 4 according to the second embodiment in the separated state, taken along a plane perpendicular to the third direction. FIG. 18 is a view of the developing cartridge 4 according to the second embodiment in the separated state as viewed in the first direction from the other side to the one side. FIG. 19 is a perspective view of the developing cartridge 4 according to the second embodiment in the separated state.

In the image-forming apparatus 100, when the drive shaft 103 is driven to start to advance in a direction from the other end portion of the casing 10 in the first direction toward the one end portion of the casing 10 in the first direction, a tip end portion of the drive shaft 103 enters the recess 262 and contacts the second inclined surface 262*c* at a position closer to another end of the second inclined surface 262*c* in the first direction.

When the drive shaft 103 further advances toward the one end portion of the casing 10 in the first direction, the second inclined surface 262*c* is pressed in the first direction from the other side toward the one side because of the contact of the second inclined surface 262*c* with the drive shaft 103. Hence, the contacting position between the second inclined surface 262*c* and the drive shaft 103 is gradually shifted on the second inclined surface 262*c* from the position closer to the other end of the second inclined surface 262*c* in the first direction to a position closer to one end of the second inclined surface 262*c* in the first direction. In accordance with this, the second inclined surface 262*c* is pressed in the second direction from the one side toward the other side because of the contact of the second inclined surface 262*c* with the drive shaft 103. In this way, the second inclined surface 262*c* is pressed by the drive shaft 103 to thereby move in the second direction while moving in the first direction. Thus, the second inclined surface 262*c* moves from the third position illustrated in FIGS. 14 through 16 to the fourth position illustrated in FIGS. 17 through 19.

Here, in the process of movement of the second inclined surface 262*c* from the third position to the fourth position, the casing 10 and the developing roller 30 move together with the second inclined surface 262*c* in the first direction and in the second direction. Hence, the first inclined surface 61*a* contacts the outer circumferential surface 250 of the second guide roller 25. In accordance with movement of the position of the first inclined surface 61*a* in the first direction from the other side toward the one side, the second guide roller 25 gradually pushes out the first inclined surface 61*a* (the casing 10) in the second direction from the one side toward the other side. In this way, the first inclined surface 61*a* moves in the second direction by being pushed by the second guide roller 25 while moving in the first direction by being pressed by the drive shaft 103. Thus, the first inclined surface 61*a* moves from the first position illustrated in FIGS. 14 through 16 to the second position illustrated in FIGS. 17 through 19.

9. Summary of Second Embodiment

As described above, in the second embodiment, the drive shaft 103 presses the second inclined surface 262*c* in the direction from the other end portion of the casing 10 in the first direction toward the one end portion of the casing 10 in the first direction. The second inclined surface 262*c* moves from the third position (FIGS. 14 through 16) to the fourth position (FIGS. 17 through 20) when the drive shaft 103 presses the second inclined surface 262*c*. Here, the pressing force directed in the first direction from the other side to the one side is converted to the force directed in the second direction by the contact between the drive shaft 103 and the second inclined surface 262*c*. As a result, the developing roller 30 can be separated from the photosensitive drum 21.

Further, the developing cartridge 4 according to the second embodiment has the recess 262 positioned at the third outer surface 13 of the one end portion of the casing 10 in the second direction. The recess 262 has the second inclined surface 262*c*. Hence, the drive shaft 103 is inserted in the recess 262 and pushes the second inclined surface 262*c*, so that the developing roller 30 can be separated from the photosensitive drum 21.

10. Modifications

The present disclosure is not limited to the above described embodiments, but various changes may be made, and various modifications are conceivable.

In the above described embodiments, the elastic member 35 urges the developing roller 30 in the direction from the one end portion of the casing 10 in the first direction toward the other end portion of the casing 10 in the first direction. However, an elastic member may urge the casing 10 in the direction from the one end portion of the casing 10 in the first direction toward the other end portion of the casing 10 in the first direction.

In the above-described embodiments, the elastic member 35 is the coil spring. Instead, a leaf spring and a sponge are available as the elastic member.

The drum cartridge 2 need not necessarily include the first guide roller 24 and the second guide roller 25. The first inclined surface may contact the drum frame of the drum cartridge when the first inclined surface moves from the first position to the second position. Further, the second inclined surface may contact the drum frame of the drum cartridge when the second inclined surface moves from the third position to the fourth position.

The shapes of the first cam 61 and the second cam 62 is not limited to the above-described shapes. For example, the first cam may have a frustoconical shape similar to the second cam.

Further, detailed configuration of the developing cartridge may be different from that described above and illustrated in the drawings, and the components in the above-described embodiments and modifications may be suitably combined together as long as no technical conflicts is raised.

What is claimed is:

1. A developing cartridge attachable to a drum cartridge including a photosensitive drum, the developing cartridge comprising:

a casing configured to accommodate therein developing agent;

a developing roller rotatable about a developing roller axis extending in a first direction, the developing roller being contactable with the photosensitive drum, the developing roller having a circumferential surface having one side portion and another side portion in a second direction crossing the first direction, the one side portion being exposed to an outside of the casing, the another side portion being positioned inside the casing; and a first inclined surface positioned at an outer surface of one end portion of the casing in the second direction, the first inclined surface being fixed to the casing, the first inclined surface being inclined relative to the first direction, the first inclined surface being movable together with the casing and the developing roller in the first direction relative to the photosensitive drum between a first position and a second position in a state where the developing cartridge is attached to the drum cartridge, wherein, in a state where the first inclined surface is at the first position, the developing roller is in contact with the photosensitive drum, and wherein, in a state where the first inclined surface is at the second position, the developing roller is in separation from the photosensitive drum.

2. The developing cartridge according to claim 1, wherein the first inclined surface has one end edge and another end edge in the first direction, and wherein a first distance in the second direction between the one end edge of the first inclined surface and the outer surface is smaller than a second distance in the second direction between the another end edge of the first inclined surface and the outer surface.

3. The developing cartridge according to claim 1 or 2, further comprising a second inclined surface positioned at the outer surface, the second inclined surface being fixed to the casing, the second inclined surface being inclined relative to the first direction, the second inclined surface being positioned away from the first inclined surface in the first direction, the second inclined surface being movable together with the first inclined surface in the first direction relative to the photosensitive drum between a third position and a fourth position in the state where the developing cartridge is attached to the drum cartridge, wherein, in the state where the first inclined surface is at the first position, the second inclined surface is at the third position and the developing roller is in contact with the photosensitive drum, and wherein, in the state where the first inclined surface is at the second position, the second inclined surface is at the fourth position and the developing roller is in separation from the photosensitive drum.

4. The developing cartridge according to claim 3, wherein the second inclined surface has one end edge and another end edge in the first direction, wherein a third distance in the second direction between the one end edge of the second inclined surface and the outer surface is smaller than a fourth distance in the second direction between the another end edge of the second inclined surface and the outer surface.

5. The developing cartridge according to claim 3, wherein the casing has one end portion and another end portion in the first direction, wherein the drum cartridge is attachable to a main body of an image-forming apparatus, wherein the main body includes a drive shaft extending in the first direction, the drive shaft being configured to advance and retract in the first direction by receiving a driving force from the main body, the drive shaft being configured to press the second inclined surface in a direction from the another end portion of the casing in the first direction toward the one end portion of the casing in the first direction, and wherein, when the drive shaft presses the second inclined surface, the second inclined surface moves from the third position to the fourth position.

6. The developing cartridge according to claim 5, further comprising a recess positioned at the outer surface of the one end portion of the casing in the second direction, and wherein the recess has the second inclined surface.

7. The developing cartridge according to claim 6, wherein, in a state where the drum cartridge is attached to the main body with the developing cartridge attached to the drum cartridge, the first inclined surface is at the second position and the second inclined surface is at the fourth position in a state where a pressing force is applied to the second inclined surface from the drive shaft, and the first inclined surface is at the first position and the second inclined surface is at the third position in a state where the pressing force is not applied to the second inclined surface from the drive shaft.

8. The developing cartridge according to claim 1, wherein the casing has one end portion and another end portion in the first direction, the another end portion of the casing in the first direction having an outer surface, the developing cartridge further comprising a pressure receiving surface positioned at the outer surface of the another end portion of the casing in the first direction, the pressure receiving surface being configured to receive a pressing force directed in a direction from the another end portion of the casing in the first direction toward the one end portion of the casing in the first direction.

9. The developing cartridge according to claim 8, wherein, when the pressure receiving surface receives the pressing force, the first inclined surface moves from the first position to the second position.

10. The developing cartridge according to claim 9, wherein the drum cartridge is attachable to a main body of an image-forming apparatus, the main body including a drive shaft extending in the first direction, the drive shaft being configured to advance and retract in the first direction by receiving a driving force from the main body, the drive shaft being configured to press the pressure receiving surface in the direction from the another end portion of the casing in the first direction toward the one end portion of the casing in the first direction, and wherein, when the drive shaft presses the pressure receiving surface, the first inclined surface moves from the first position to the second position.

11. The developing cartridge according to claim 10, wherein the developing roller comprises:

a roller body extending in the first direction; and a developing roller shaft rotatable together with the roller body, the developing roller shaft having one end portion and another end portion in the first direction, the developing cartridge further comprising:

a collar positioned at the one end portion of the developing roller shaft in the first direction, the collar rotatably supporting the developing roller shaft; and an elastic member positioned between the roller body and the collar in the first direction.

12. The developing cartridge according to claim 11, wherein the elastic member is a spring.

13. The developing cartridge according to claim 12, wherein the spring is a coil spring.

14. The developing cartridge according to claim 11, wherein, when the drum cartridge is attached to the main body in the state where the developing cartridge is attached to the drum cartridge, the elastic member urges one of the developing roller and the casing in a direction from the one end portion of the casing in the first direction toward the another end portion of the casing in the first direction.

15. The developing cartridge according to claim 11, wherein the collar is electrically connected to the developing roller.

16. The developing cartridge according to claim 11, wherein, when the drum cartridge is attached to the main body in the state where the developing cartridge is attached to the drum cartridge, a direction in which the elastic member urges one of the developing roller and the casing is opposite to a direction in which the drive shaft presses the pressure receiving surface.

17. The developing cartridge according to claim 11, wherein, when a supply of the driving force from the main body to the drive shaft is stopped in a state where the drum cartridge is attached to the main body with the developing cartridge attached to the drum cartridge, the first inclined surface moves from the second position to the first position by an urging force of the elastic member.

18. The developing cartridge according to claim 10, wherein, in a state where the drum cartridge is attached to the main body with the developing cartridge attached to the drum cartridge, the pressure receiving surface is overlapped with the drive shaft in the first direction both when the first inclined surface is at the first position and when the first inclined surface is at the second position.

19. The developing cartridge according to claim 10, wherein, in a state where the drum cartridge is attached to the main body with the developing cartridge attached to the drum cartridge, the first inclined surface is at the second position in a state where the pressing force is applied to the pressure receiving surface from the drive shaft, and the first inclined surface is at the first position in a state where the pressing force is not applied to the pressure receiving surface from the drive shaft.

20. The developing cartridge according to claim 8, wherein the pressure receiving surface is a flat surface perpendicular to the first direction.

21. The developing cartridge according to claim 1, wherein the drum cartridge has a contact surface contactable with the first inclined surface.

22. The developing cartridge according to claim 21, wherein the contact surface is an outer circumferential surface of a cylindrical member whose center is a rotation axis extending in a third direction crossing both the first direction and the second direction.

23. The developing cartridge according to claim 22, wherein the cylindrical member is rotatable about the rotation axis.

24. The developing cartridge according to claim 1, wherein the first inclined surface has one end edge and another end edge in the first direction, the first inclined surface being inclined so as to be distant in the second direction from the outer surface of the one end portion of the casing in the second direction as extending from the one end edge of the first inclined surface to the another end edge of the first inclined surface.

* * * * *